US007338416B2

(12) United States Patent
Smith

(10) Patent No.: US 7,338,416 B2
(45) Date of Patent: Mar. 4, 2008

(54) BAR SUPPORTS FOR A WEIGHT BENCH

(75) Inventor: Robert J. Smith, Louisville, CO (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 11/204,579

(22) Filed: Aug. 15, 2005

(65) Prior Publication Data

US 2006/0035765 A1 Feb. 16, 2006

Related U.S. Application Data

(60) Provisional application No. 60/602,154, filed on Aug. 16, 2004.

(51) Int. Cl.
*A63B 21/078* (2006.01)
*A63B 21/072* (2006.01)

(52) U.S. Cl. ..... 482/104; 482/94; 482/106; 482/135; 482/908; 248/125.3; 248/220.31

(58) Field of Classification Search ..... 482/38, 482/39, 41, 42, 93, 94, 101, 104, 106, 108, 482/135, 138, 142, 148, 908, 17, 37; D21/691, D21/686, 690, 694, 676, 673, 662; 182/228.3, 182/228.4; 403/106, 108, 353; 248/295.11, 248/219.4, 222.52, 125.1, 125.3, 217.1, 219.1, 248/220.21, 220.31, 224.8, 228.2, 230.2, 248/239, 297.31; 119/705

See application file for complete search history.

(56) References Cited

U.S. PATENT DOCUMENTS

| | | | | |
|---|---|---|---|---|
| 3,156,465 | A * | 11/1964 | Jacobi | 482/37 |
| 3,342,485 | A | 9/1967 | Gaul | |
| 3,707,285 | A | 12/1972 | Martin | |
| 4,286,782 | A | 9/1981 | Fuhrhop | |
| 4,535,985 | A | 8/1985 | Mask | |
| 4,540,171 | A | 9/1985 | Clark et al. | |
| 4,700,944 | A | 10/1987 | Sterba et al. | |
| 4,729,561 | A | 3/1988 | Desjardins | |
| 4,795,149 | A | 1/1989 | Pearson | |
| 4,804,179 | A | 2/1989 | Murphy et al. | |
| 4,815,746 | A | 3/1989 | Ward, Jr. | |

(Continued)

FOREIGN PATENT DOCUMENTS

FR 2 561 528 A1 9/1985

(Continued)

OTHER PUBLICATIONS

Yukon Fitness Equipment, TK-400, Caribou II Gym, 1994-95 Catalog, 16 pages.

(Continued)

*Primary Examiner*—Kevin C. Sirmons
*Assistant Examiner*—Victor K. Hwang
(74) *Attorney, Agent, or Firm*—Dorsey & Whitney LLP

(57) ABSTRACT

A bar support member that can be used to hold a weight bar in a desired position on a piece of exercise equipment. Additionally, embodiments of the present invention can be used to provide a safety stop or spotter for supporting the weight bar in the event that the user cannot return the weight bar to its original bar support member.

14 Claims, 25 Drawing Sheets

U.S. PATENT DOCUMENTS

| | | | | |
|---|---|---|---|---|
| 4,861,025 | A | 8/1989 | Rockwell | |
| 4,907,798 | A | 3/1990 | Burchatz | |
| 5,050,868 | A | 9/1991 | Pearson | |
| 5,108,095 | A | 4/1992 | Nichols | |
| 5,328,428 | A | 7/1994 | Huang | |
| 5,346,448 | A * | 9/1994 | Sollo | 482/104 |
| 5,626,548 | A | 5/1997 | Coyle | |
| 5,669,859 | A | 9/1997 | Liggett et al. | |
| D390,287 | S * | 2/1998 | Hsieh et al. | D21/676 |
| 5,727,764 | A * | 3/1998 | Angeles | 482/104 |
| 5,755,823 | A * | 5/1998 | Cleary | 482/104 |
| 5,762,590 | A | 6/1998 | St. Fleur et al. | |
| 5,788,616 | A * | 8/1998 | Polidi | 482/104 |
| 5,830,116 | A | 11/1998 | Gautier | |
| D444,827 | S * | 7/2001 | Mobley | D21/694 |
| 6,264,586 | B1 | 7/2001 | Webber | |
| 6,361,482 | B1 | 3/2002 | Batca et al. | |
| 6,394,935 | B1 | 5/2002 | Lake | |
| 6,482,139 | B1 | 11/2002 | Haag | |
| 6,551,226 | B1 | 4/2003 | Webber et al. | |
| 6,685,601 | B1 | 2/2004 | Knapp | |
| 6,746,379 | B1 * | 6/2004 | Brawner | 482/104 |
| 6,770,017 | B1 | 8/2004 | Leipheimer | |
| 7,004,891 | B2 | 2/2006 | Morris et al. | |
| 7,115,080 | B2 | 10/2006 | Cockrill, Jr. et al. | |
| 2002/0147086 | A1 * | 10/2002 | Walsh | 482/142 |
| 2006/0063650 | A1 | 3/2006 | Francis | |

FOREIGN PATENT DOCUMENTS

| | | |
|---|---|---|
| FR | 2 613 237 A1 | 10/1988 |
| FR | 2 627 090 A1 | 8/1989 |

OTHER PUBLICATIONS

Body-Solid, Pro-Smith Gym, #WSM-44, Body-Solid Strength Training Equipment Catalog, copyright 2000, 8 pages.
Nautilus® Free Weight Equipment 2001 brochure, 14 pages (2001).
"Nautilus Home Health & Fitness Catalog," Nautilus, Inc., pp. 1-56 (2004).
Soloflex catalog, p. 23 (1981).

* cited by examiner

BAR SUPPORTS FOR A WEIGHT BENCH

CROSS-REFERENCE TO RELATED APPLICATION

This application claims priority to U.S. Provisional Application No. 60/602,154, filed on Aug. 16, 2004 and entitled "Bar Supports For a Weight Bench", which is hereby incorporated herein by reference.

FIELD OF THE INVENTION

This invention relates, in general, to fitness and exercise equipment.

BACKGROUND

During fitness exercises such as weightlifting, a user may lift a weight bar during exercises such as bench presses, squats, and other exercises involving free weights. Commonly, fitness equipment such as weight benches, Olympic benches, stationary benches, adjustable benches, conventional benches, or weight machines including full-cage and half-cage stations and Smith cages may be used to support the weight bar for such exercises before and between repetitions. The equipment is used to support the weight bar in a standby position before and between repetitions. Often times it is desirable to be able to adjust the position at which the weight bar is supported in order to accommodate different users or different exercises. Such exercises may require an additional person acting as a spotter to assist the user during the exercises in the event that the user cannot return the weight bar to its original starting position. If the spotter is unable to hold the weight, there may be a risk of injury to the user.

Accordingly, what is needed is a system for providing support of a weight bar that allows easy adjustment of a standby position and can be used in addition to or in place of a spotter.

BRIEF SUMMARY OF THE INVENTION

Embodiments of the present invention provide for adjustably holding and supporting a weight bar within a piece of fitness or exercise equipment such as a weight bench or a weight machine. Examples of such fitness equipment include, but are not limited to, weight benches such as Olympic benches, stationary benches, adjustable benches, or other benches including conventional benches; and weight machines including full-cage and half-cage weight stations or machines or Smith machines or Smith cages, for example. Embodiments of the present invention may be used with free weights on a weight bar, and could also be used with dumbbells or barbells if desired.

Embodiments of the present invention also provide safety stops or spotter bars in the event that during an exercise, the user is unable to return the weight bar/weights to the initial position, or if the user is unable to lock the weight bar within a Smith machine/rack. Hence, embodiments of the present invention can provide an additional level of safety to users during exercises such as bench presses, squats, chest exercises, or other exercises that involve the use of free weights or weights attached to a weight bar.

In one aspect of the present invention, an exercise device for use with a weight bar includes: a first upright member having a plurality of apertures; a second upright member having a plurality of apertures; a first weight bar holder having a body portion, a bar support member, and an engagement member for securement within one of said plurality of apertures of said first upright member; and a second weight bar holder having a body portion, a bar support member, and an engagement member for securement within one of said plurality of apertures of said second upright member.

In another form of the present invention, a weight bar support for supporting a portion of a weight bar on an exercise device of the type that includes an upright with a plurality of vertically spaced apertures, includes: a body including a front member and a pair of side members that extend generally rearwardly from the front member; a retainer attached to the side members such that the retainer member is offset rearwardly from the front member; the front member, side members, and retainer forming a first passageway for receiving the upright such that the body and retainer are slidable together on the upright; an engagement member extending into the first passageway for selective engagement with the vertically spaced apertures in the upright member to prevent the body and retainer from sliding on the upright when the engagement member is engaged with one of the apertures; and a weight bar support member extending generally forwardly from the body for supporting a portion of the weight bar on the exercise machine when the engagement member is engaged with one of the apertures.

In yet another form of the present invention, an exercise device for use with a weight bar includes: a frame having a front left riser, a rear left riser located generally rearwardly from the front left riser, a front right riser located generally to the right of the front left riser and a rear right riser located generally rearwardly from the front right riser; each of the risers including a side surface provided with a plurality of apertures; a left spotter bar for selective mounting between the front left riser and rear left riser including: a left elongated bar support member provided with a left front attachment bracket for attachment to the front left riser and a left rear attachment bracket for attachment to the rear left riser; a right spotter bar for selective mounting between the front right riser and the rear right riser including: a left elongated bar support member provided with a right front attachment bracket for attachment to the front right riser and a right rear attachment bracket for attachment to the rear right riser; and wherein the attachment brackets each include: a tab for selective engagement with one of the apertures on a corresponding one of the risers and a protrusion for engaging the corresponding riser on a surface opposed to the side surface provided with apertures.

In still another form of the present invention, a weight stop for use with an exercise device of the type including a shuttle attached to a weight bar, the shuttle being slidably received on a guide bar, the exercise device further including an upright with a plurality of apertures, the weight stop including: a front wall; a pair of spaced apart sidewalls extending generally rearwardly from the front wall; a retainer supported by the sidewalls generally above and rearward from the front wall such that a passageway is formed by the front wall, sidewalls and retainer for receiving a portion of the upright to slidably mount the weight stop on the upright; an engagement member extending into the passageway for selective engagement with one of the plurality of apertures to secure the weight stop to the upright and prevent downward sliding motion of the weight stop relative to the upright; and a shuttle supporting member extending generally forwardly from the front wall including a bearing surface for supporting the shuttle when the engagement member is engaged with one of the plurality of apertures.

The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Embodiments of the present invention provide a bar support member that can be used to hold a weight bar in a desired position on a piece of exercise equipment. Additionally, embodiments of the present invention can be used to provide a safety stop or spotter for supporting the weight bar in the event that the user cannot return the weight bar to its original bar support member. Various embodiments of the present invention are described herein.

Figure 1:
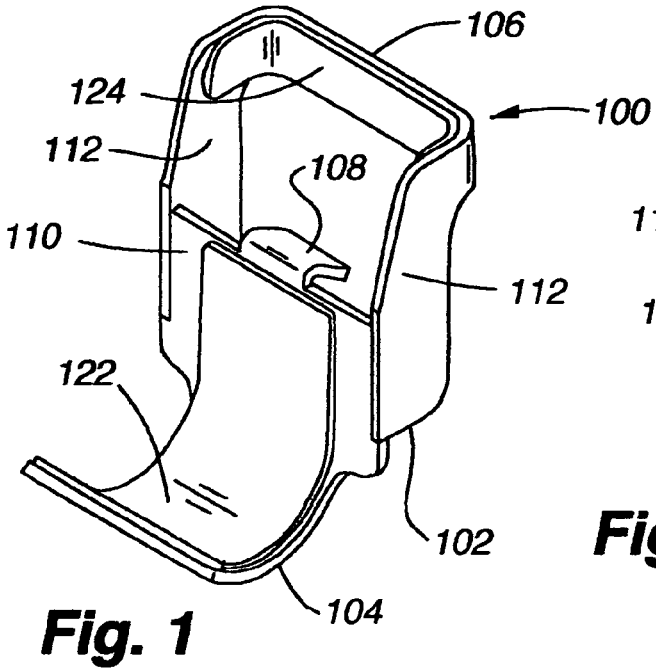
FIG. 1 is an isometric view of a weight bar holder according to one embodiment of the present invention.
Figure 2:
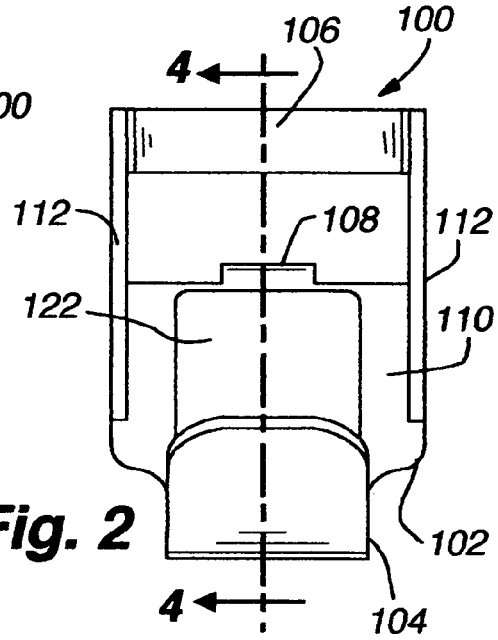
FIG. 2 is a front elevation view of the weight bar holder of FIG. 1.
Figure 3:
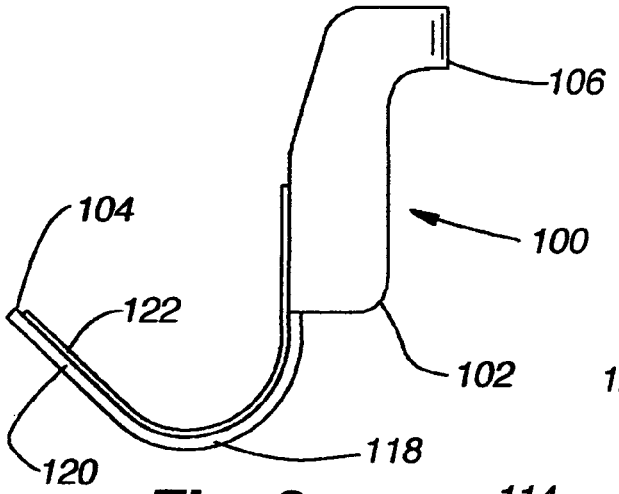
FIG. 3 is a right side elevation view of the weight bar holder of FIG. 1.
Figure 4:
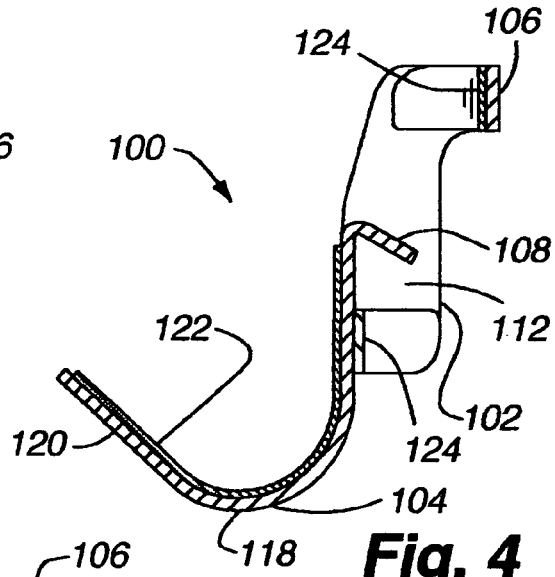
FIG. 4 is a cross sectional view of the weight bar holder of FIG. 1 taken along line 4-4 of FIG. 2.
Figure 5:
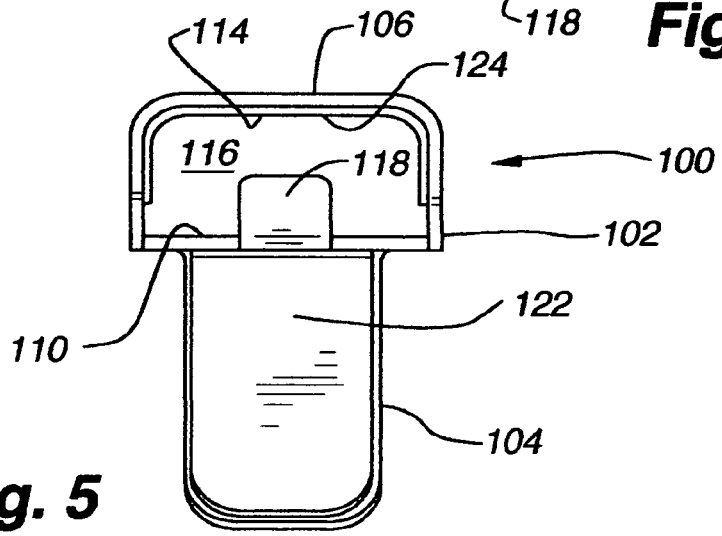
FIG. 5 is a top plan view of the weight bar holder of FIG. 1.

FIGS. 1-5 show a weight bar holder 100 according to one embodiment of the present invention. In the embodiment shown in FIGS. 1-5 the weight bar holder 100 includes a body portion 102, a bar support member 104, a retainer 106, and an engagement member 108. The body portion 102 includes a front member in the form of front wall 110 and a pair of opposing side members in the form of sidewalls 112 that extend generally perpendicularly and rearwardly from the front wall 110. The retainer 106 is provided at an upper rear portion of the sidewalls 112 and is located generally above the front wall 110. An inner surface 114 of the retainer 106 faces generally forwardly parallel with the front wall 110. As best seen in FIG. 5, the front wall 110, retainer 106, and sidewalls 112 define a generally rectangular cavity or passageway 116 within the weight bar holder 100 which is suitable for receiving a riser or other support member. It should be appreciated that the front face 110, sidewalls 112, and retainer 106 could be shaped to accommodate any variety of cross sections of risers.

The engagement member 108 extends from a top edge of the front wall 110 rearwardly into the passageway 116. In the embodiment shown, the engagement member 108 is a generally rectangular tab that extends at a downward angle of approximately 60 degrees with respect to front wall 110. The engagement member 108 may take the form of a hook, hanger, tongue, or the like, and the overall shape is not critical to the functioning of the unit. The length, shape, and angle of the engagement member 108 may be varied depending on the implementation.

The bar support member 104 extends generally forwardly from the bottom portion of the front wall 110. The bar support member 104 should be shaped appropriately to support a portion of a weight bar. In the embodiment shown, the bar support member 104 includes a rounded cradle portion 118 for supporting a weight bar and a sloped free end 120 that tends to guide or urge a weight bar down to the rounded lower portion 118. Thus a cradle is formed by the bar support member 104 to capture and support a portion of a weight bar. Preferably, a pad 122 may be provided on the cradle surface of the support bar member 104 to prevent damage and noise due to direct contact between the weight bar and the bar support member 104.

Gripping pads 124 may be provided on the inner surface 114 of the retainer 106 as well as the rearward facing surface of the front wall 110. These gripping pads 124 may be attached to the front wall 110 and retainer 106 by adhesive, or other known methods. Preferably the gripping pads 124 will have a high coefficient of friction to enhance the grip between the weight bar holder 110 and a riser or upright received within the passageway 116. The gripping pads 124 also serve to reduce wear and fatigue that could occur by direct contact between the front wall 110 or retainer 106 with a riser. Foam rubber, or similar materials, may be suitable for forming the gripping pads 124.

The weight bar holder 100 shown in FIGS. 1-5 may be formed from two pieces of metal, for example, hardened steel or aluminum. The bar support member 104, front wall 110, and engagement member 108 could be stamped and bent from a first piece of metal, and the sidewalls 112, and retainer 106 stamped and bent from a second piece of metal. The two pieces of metal may then be joined by welding, and the pads 122 and 124 can be applied to the appropriate portions. Alternatively, the weight bar holder 110 may be formed by injection molding of hard plastic resin, or composite materials as a single unitary body. Those of ordinary skill in the art may be aware of additional materials and methods for fabricating the weight bar holder 100.

The location and shape of various features may also be varied. For example, while it is preferred to locate the engagement member 108 at the top of the front wall 110, as it is the most convenient location for placing the engagement member 108 in engagement with a riser, the engagement member 108 could be located in alternative positions. For example, the engagement member 108 need not necessarily be centered laterally on the front wall 110. The engagement member 110 could be located below the top surface of the front wall 110; however, this would hide the engagement member 108 from view during use, and may make engagement with a riser more cumbersome. Similarly, the engagement member 108 could be located so that it extends inwardly into the passageway 116 off of the retainer 106.

In the embodiment shown in FIGS. 1-5, the front wall 110 and bar support member 104 define a generally U-shaped or J-shaped cradle for supporting a weight bar. It should be understood that other shapes may also be useful and acceptable for supporting a weight bar and preventing it from rolling off of the bar support member 104. For example, L-shapes and V-shapes should be acceptable.

Figure 6:
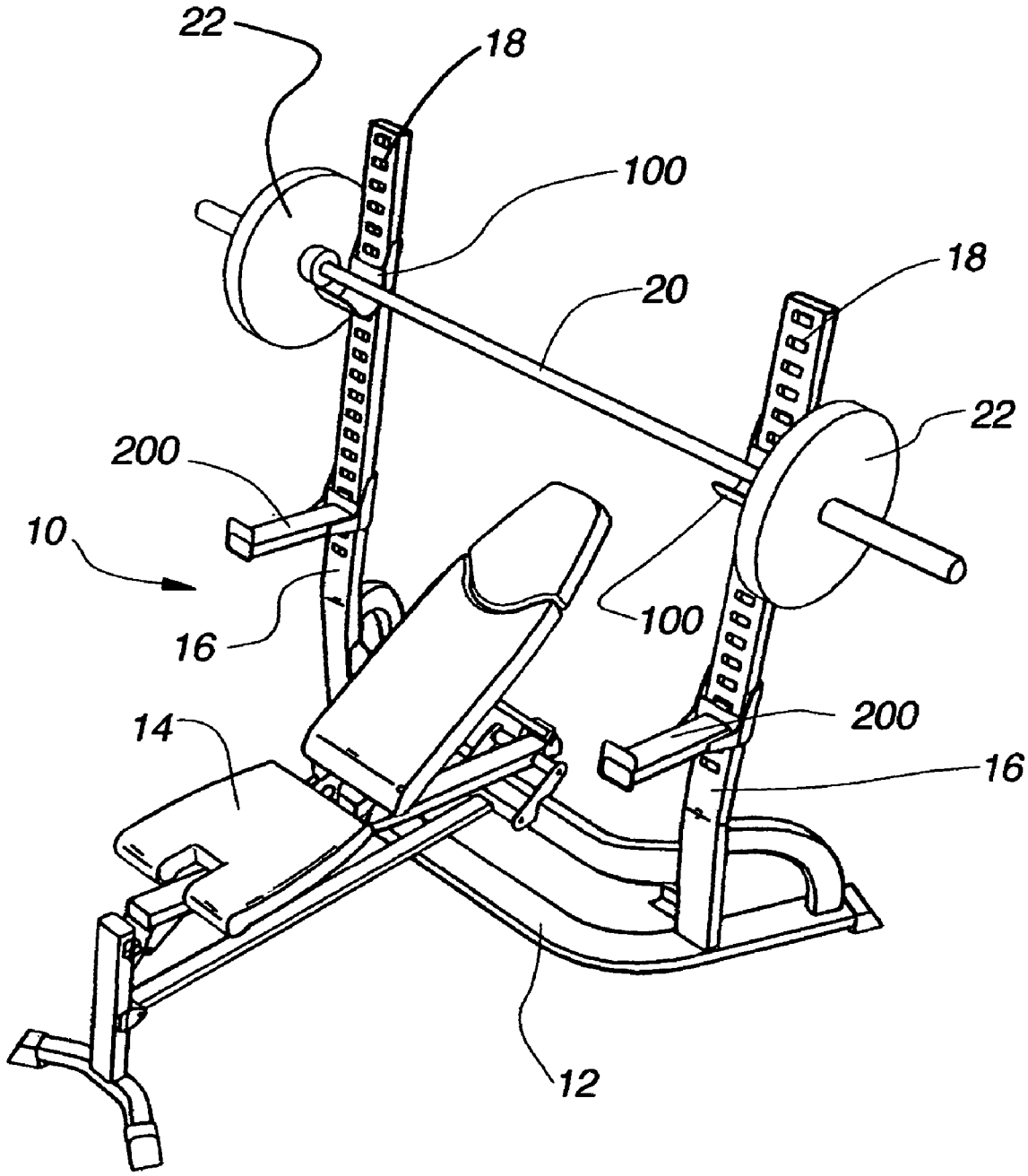
FIG. 6 is an isometric view of a weight bench incorporating the weight bar holder of FIG. 1.

FIG. 6 shows a piece of exercise equipment in the form of a weight bench 10 according to one embodiment of the present invention. The weight bench 10 includes a frame 12 that supports an adjustable bench 14 located generally between a pair of uprights 16. In the embodiment of FIG. 6 the uprights 16 are provided with a plurality of apertures in the form of vertically offset slots 18. Each upright 16 is engaged by a corresponding weight bar holder 100. Safety spotters 200 (see FIGS. 15-27 and related discussion) are also provided on the uprights 16. A weight bar 20 with attached weight plates 22 sits in a resting position supported by the weight bar holders 100. A user may sit or lay on the bench 14 and exercise by repetitively lifting the weight bar 20, for example in a bench press fashion. It should be understood that the weight bench 10 may take various shapes and forms. In the example shown in FIG. 6 the upright members 16 are tubular with a generally rectangular cross section, although other shapes and forms may be used such as solid or reinforced uprights with round, square, triangular or other shaped cross sections. Similarly, while the apertures are shown as rectangular slots 18, other shapes may be used depending on the desired implementation and the shape of the engagement member 108.

The plurality of vertically spaced slots 18 on the uprights 16 permit the weight bar holder 100 to be attached to the uprights 16 at a variety of heights. Preferably the weight bar holders 100 on the left and right uprights 16 will be adjusted to the same height so that the weight bar 20 will be generally level when supported by the weight bar holders 100. The plurality of slots 18 permits a user to select from a variety of locations to support the weight bar 20 depending on the size of the user, the exercise to be performed, and the positioning of the bench 14. Generally speaking, the location of the weight bar holder 100 should be a position that allows a user to comfortably position themselves beneath the bar 20, and serves as a resting position from which a user removes the bar to begin exercising, and returns the bar 20 at the conclusion of the set.

The material and thickness of parts chosen to fabricate the weight bar holder 100 must be sufficient to withstand the expected weight of the weight bar 20 and weight plates 22. Taking into consideration that the weight bar holders 100 may be required to hold the weight bar 20 for long periods of time, and may be subjected to frequent impact loading as the bar 20 is dropped or set onto the weight bar holders 100.

Figure 7:
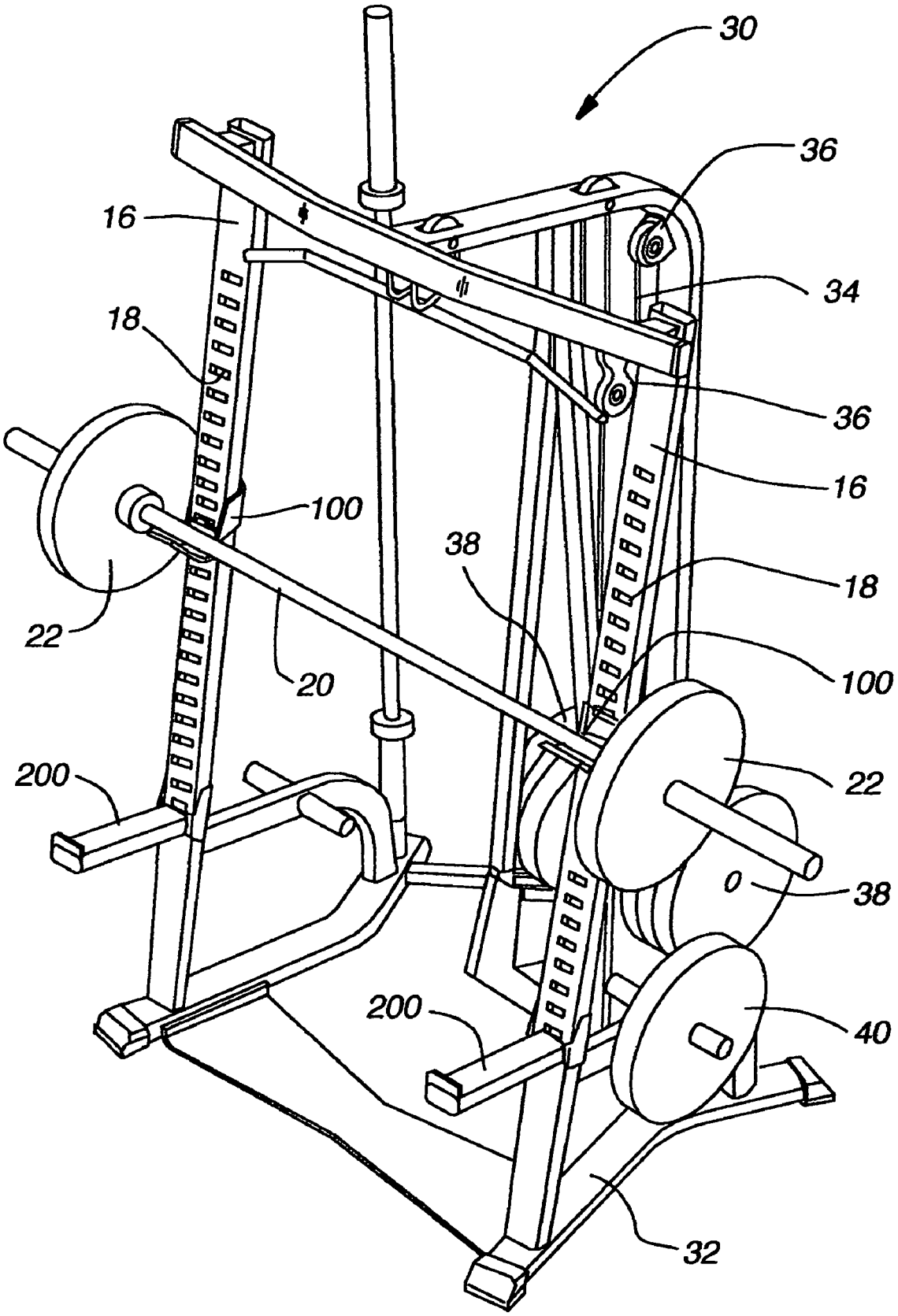
FIG. 7 is an isometric view of a half-cage weight rack incorporating the weight bar holder of FIG. 1.

FIG. 7 shows an additional piece of exercise equipment according to the present invention in the form of a half-cage weight machine 30. The half-cage weight machine 30 includes a frame 32 that is adapted to support various configurations of cables 34 and pulleys 36 that are operably connected with weight stacks 38. Spare weight plates 40 may be stored on the frame 32. The frame 32 also supports a pair of uprights 16 having a plurality of apertures 18 along their length. A pair of weight bar holders 100 are provided on the uprights 16. The weight bar holders 100 are slidably adjusted along the uprights 16 in order to support a weight bar 20 at a desired height. An exercise, such as squats may be performed by lifting the weight bar 20 up off of the weight bar holder 100 and performing the repetitions generally outside of the half-cage weight machine 30, and then returning the weight bar 20 to the weight bar holder 100 upon completion of the desired number of repetitions. The starting height for the weight bar 20 may be adjusted by varying the location of the weight bar holders 100 on the uprights 16 to account for the size of the user and the exercise to be performed. Weight bar spotters 200 may also be provided on the uprights 16 below the weight bar holders 100 to support and retain the weight bar 20 in case a user is unable to return the weight bar 20 all the way up to the weight bar holders 100 upon completion of the repetitions.

Figure 8:
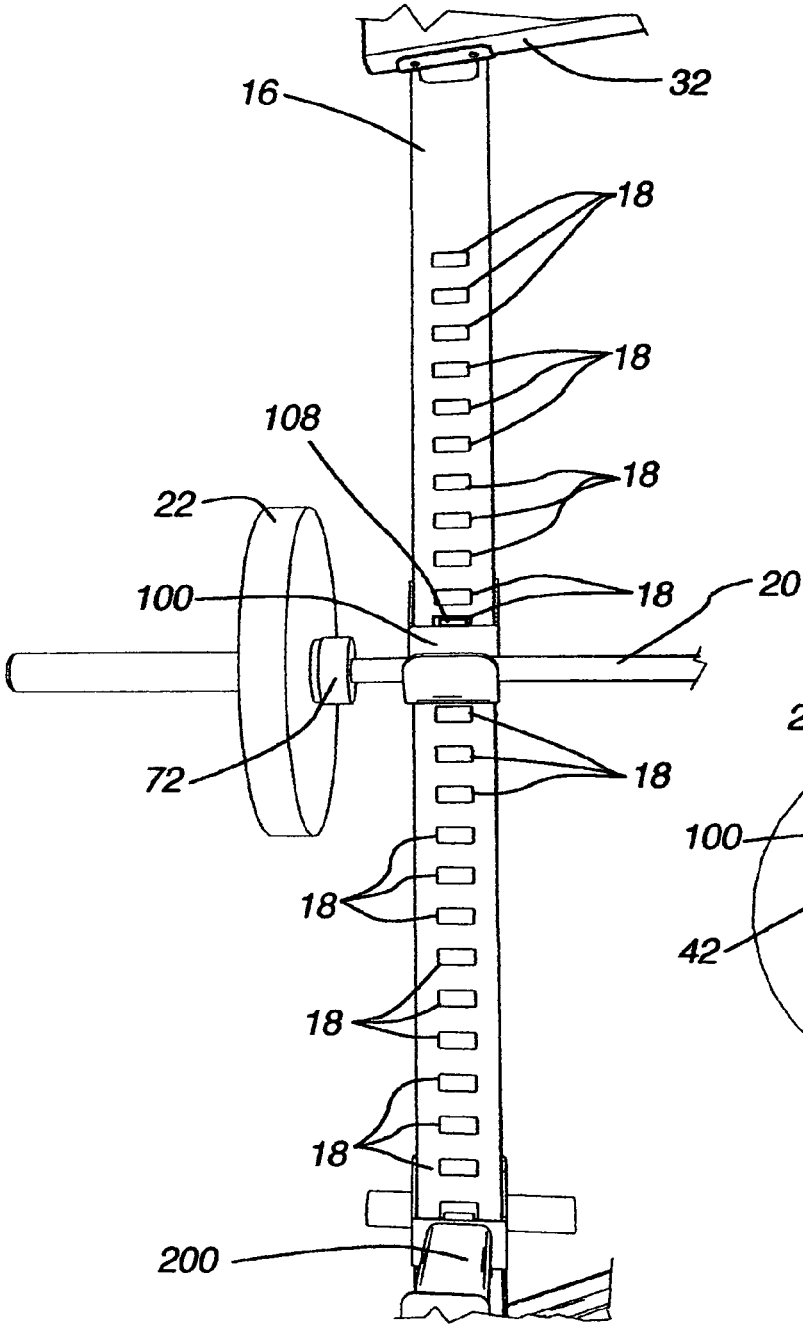
FIG. 8 is a partial front detail view of a left upright of the half-cage weight rack of FIG. 7.
Figure 9:
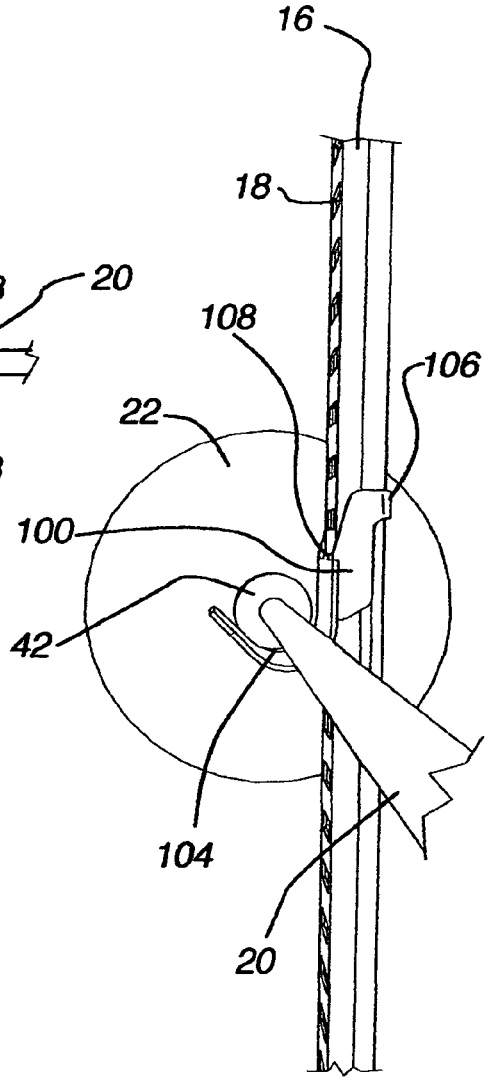
FIG. 9 is a partial perspective detail of the right side of the left upright of the half-cage weight rack of FIG. 7.
Figure 10:
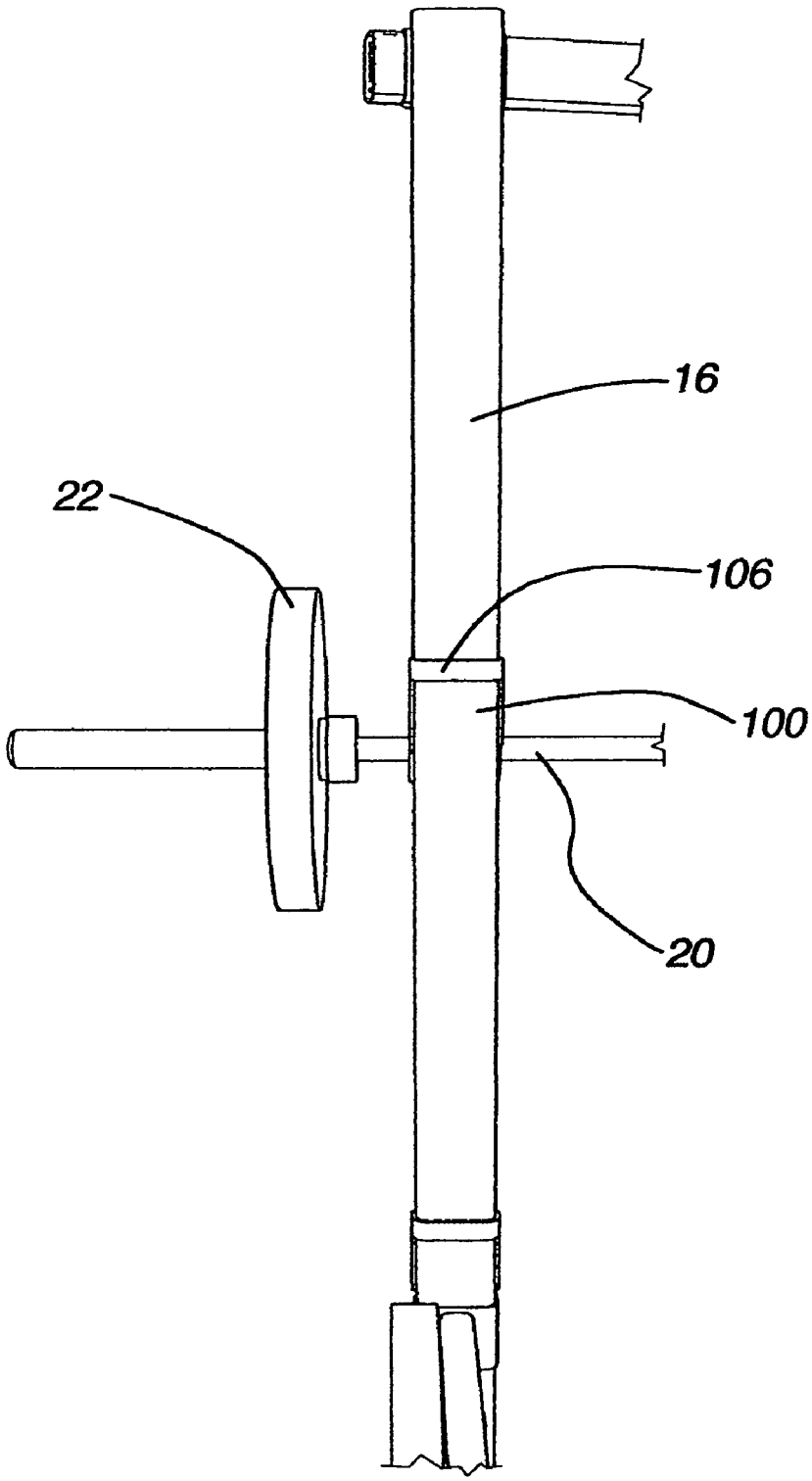
FIG. 10 is a partial rear perspective view of the right upright of the half-cage weight rack of FIG. 7.

FIGS. 8-10 are detail views of the left riser 16 and corresponding weight bar holder 100 from the half-cage weight machine 30 of FIG. 7. It should be appreciated that the weight bar holder 100 would not be limited in use to the half-cage weight machine 30 or the weight bench 10, but would be well suited for use on a wide variety of weight machines and other exercise equipment that utilizes risers or uprights to support a weight bar. Accordingly, while FIGS. 8-10 relate to the half-cage weight machine 30 of FIG. 7, the weight bar holder 100 of the present invention is by no means limited to such an embodiment. As can be seen in FIGS. 8 and 9, the weight bar holder 100 is supported on the riser 16 by the engagement of tab 108 with the top surface of a slot 18. The tab 108 may be inserted into any of the slots 18 to support the weight bar holder 100 at the desired height. Preferably, each slot 18 on the left riser 16 will have a corresponding slot 18 at the same height on the right-hand upright 16. Preferably, in use, the weight bar holders 100 on each upright 16 will be adjusted to the same height so that the weight bar 20 will be supported in a generally level orientation. In order to adjust the position of the weight bar holder 100 on the upright 16, it is necessary to remove the weight bar 20 from the cradle 104. It is also generally preferable that the weight plates 22 be attached to the weight bar 20 outside of the risers 16, such that both risers 16 are located between the weight plates 22. A collar 42 may be attached to the weight bar 20 to prevent the weight plates 22 from slipping inward on the bar 20, which would interfere with placement of the weight bar 20 into the cradle 104 of the weight bar holder 100.

The retainer portion 106 of the weight bar holder 100 wraps around the upright 16, as best seen in FIG. 10. When the weight bar 20 is retained by the cradle 104, it pushes downwardly on the cradle 104 causing a moment to be applied to the weight bar holder 100 that tends to twist the weight bar holder 100 such that the inner surfaces of the retainer 106 and front wall 110 are pressed against the riser 16. The friction between the riser 16 and the inner surfaces of the retainer 106 and front wall 110 provide support in addition to the engagement member 108 to hold the weight bar holder 100 in place on the riser 16. This frictional support may be enhanced by the gripping pads 124.

Figure 12:
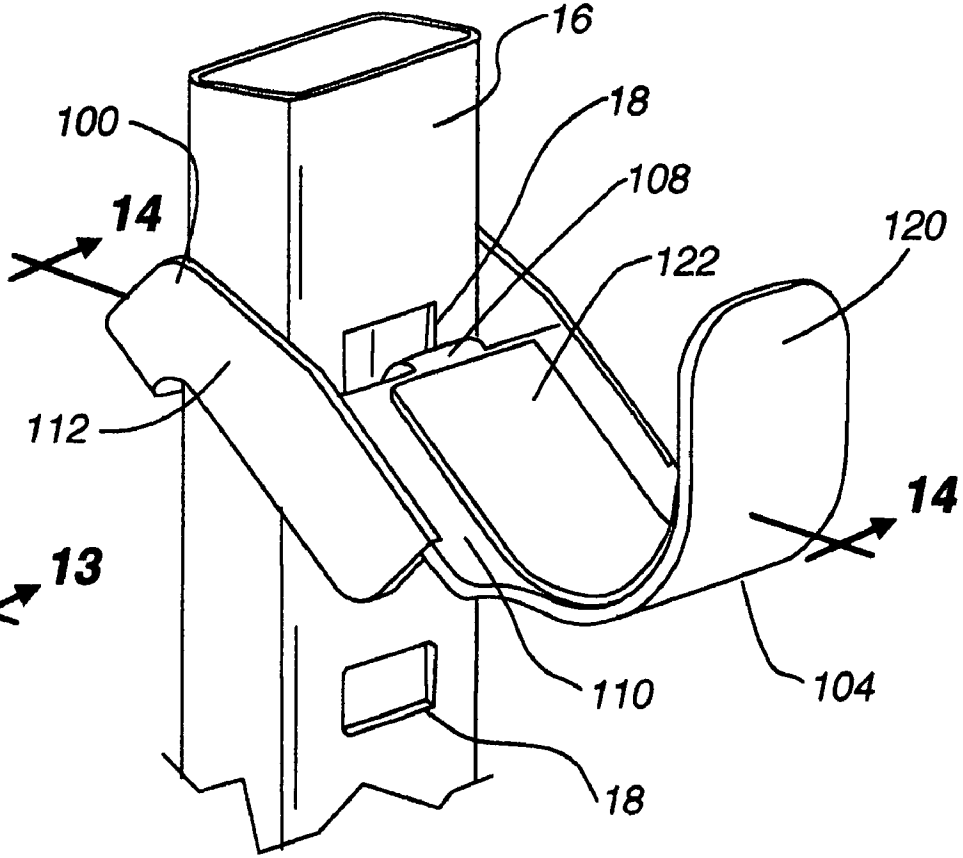
FIG. 12 is a partial isometric detail view of the weight bar holder and upright of FIG. 11 with the weight bar holder tilted into an adjustable position.
Figure 11:
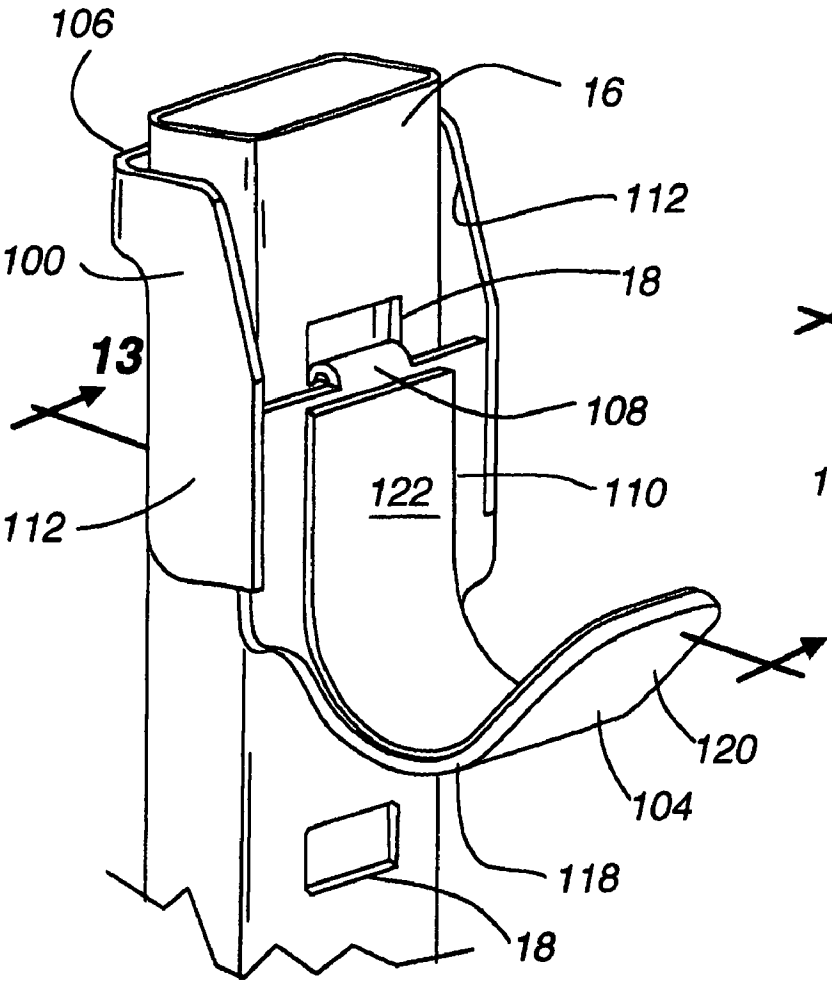
FIG. 11 is a partial isometric detail view of a weight bar holder according to the embodiment of FIG. 1 in a weight bar supporting position on an upright.
Figure 13:
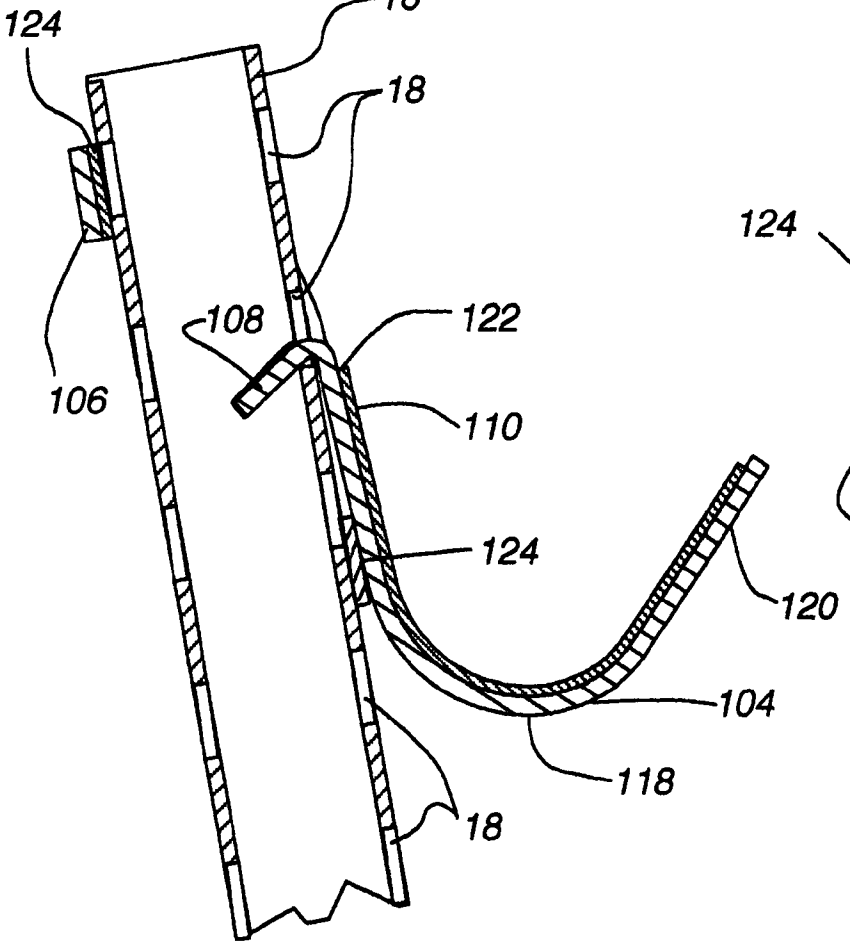
FIG. 13 is a cross sectional view of the weight bar holder and upright of FIG. 11 taken along line 13-13 of FIG. 11.
Figure 15:
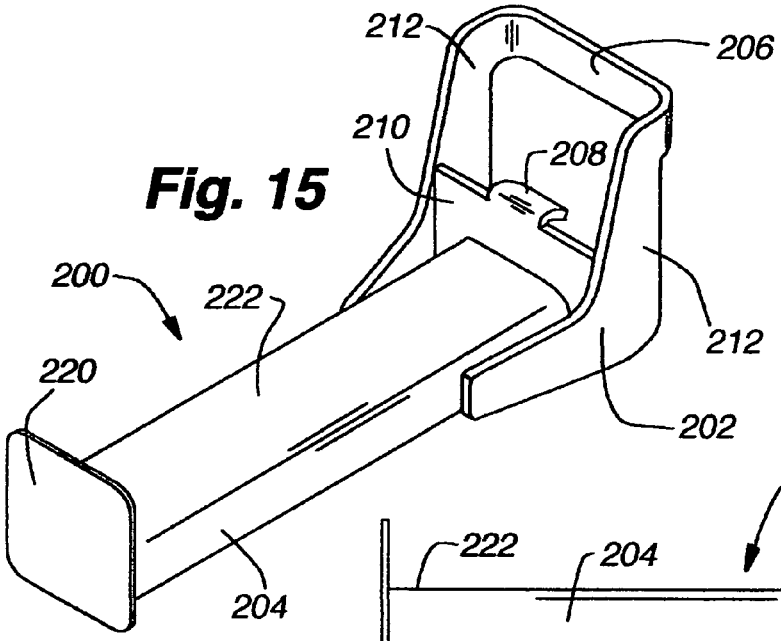
FIG. 15 is an isometric view of a spotter according to one embodiment of the present invention.
Figure 16:
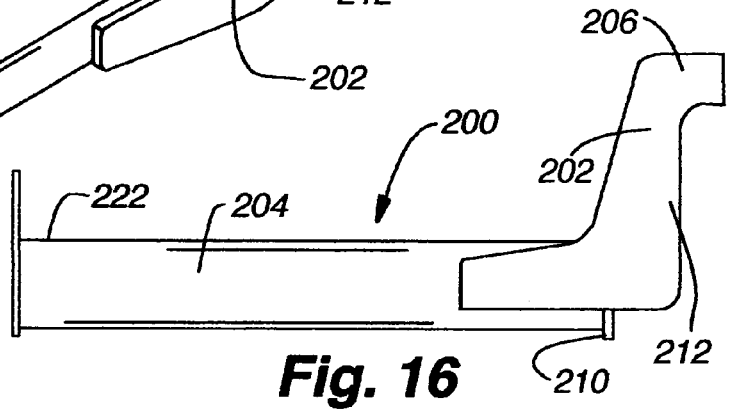
FIG. 16 is a right side elevation view of the spotter of FIG. 15.
Figure 17:
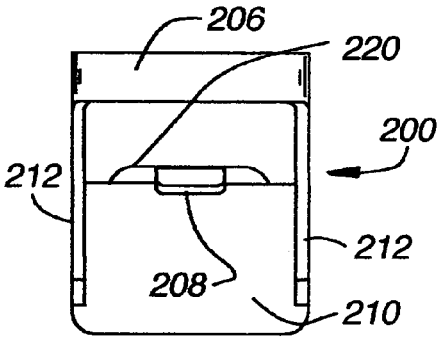
FIG. 17 is a rear elevation view of the spotter of FIG. 15.
Figure 18:
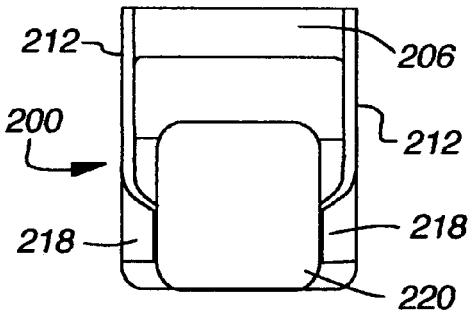
FIG. 18 is a front elevation view of the spotter of FIG. 15.

FIGS. 11-14 illustrate the positional adjustment of a weight bar holder 100 upon an upright 16, according to one embodiment of the present invention. While not shown, it should be understood that the riser 16 is preferably attached to the frame of an exercise machine such as a weight bench 10, a half-cage weight machine 30, or other exercise devise that utilizes a weight bar. FIGS. 11 and 13 show a weight bar holder 100 in a weight supporting position. In this position, the weight bar holder 100 is suitable for receiving and supporting a weight bar. The lower surface of the tab 108 engages the bottom edge of slot 18. The retainer 106 is wrapped around the rear surface of riser 16 and the gripping pad 124 attached to the inner surface 114 of the retainer 106 is pressed flat against the back surface of the upright 16. Similarly, the gripping pad 124 provided on the front wall 10 is pressed flat against the front surface of the upright 16. When weight is applied to the bar support member 104, as for example when a weight bar 20 is in place within the cradle 118, the gripping pads 124 are pressed tightly against the upright 16 by the resulting moment. The sidewalls 112 may also be configured with a slight interference fit to press against the side surfaces of the upright 16. The combination of the friction between the upright 16 and the gripping pads 124 along with the bearing of the engagement member 108 against the top surface of the slot 18 serves to securely support the weight bar holder 100 in place on the upright 16. The engagement member 108 should have sufficient length that it is unlikely to inadvertently slip free from the slot 18, even if a weight bar 20 is allowed to bounce against the weight bar holder 100 and thus jostle the weight bar holder 100. The downward angle of the engagement member 108 relative to the front wall 110 of the weight bar holder 100 is useful for guiding and urging the weight bar holder 100 into the secure position of FIG. 13. If the weight bar holder 100 is jostled slightly out of position, the weight of the weight bar holder 100 and especially the weight bar 20 will cause the bottom surface of the engagement member 108 to ride along the top edge of the slot 18 until the secure position of FIG. 13 is achieved. The steeper the angle between the engagement member 108 and the front face 110, the more pronounced this effect will be. Similarly, the engagement member 108 should be long enough that a slight lateral displacement of the weight bar holder 100 will not cause the engagement member 108 to slip completely out of the slot 18. The longer the engagement member 108 is made, the less likely it will be to inadvertently slip out of the slot 18. However, longer engagement members 108 may be more cumbersome to guide into the slots 18.

Figure 14:
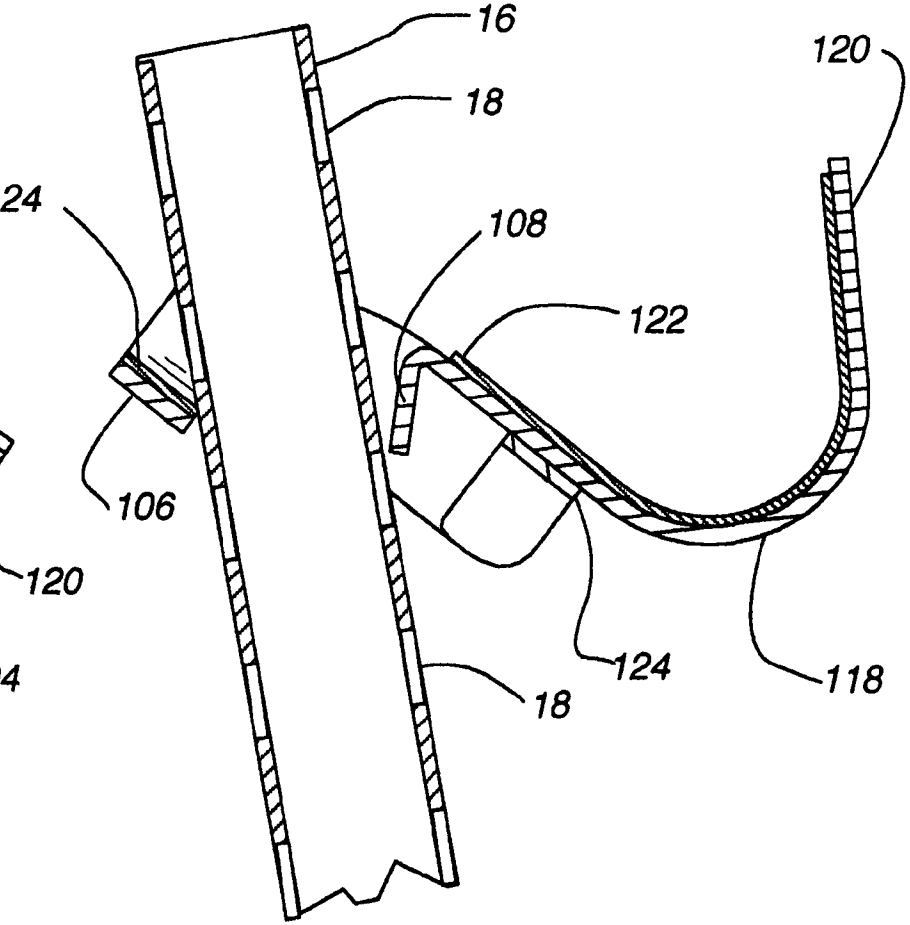
FIG. 14 is a cross sectional view of the weight bar holder and upright of FIG. 12 taken along line 14-14 of FIG. 12.

In order to adjust the height of the weight bar holder 100 on the upright 16 the engagement member 108 is moved to a desired slot 18. To accomplish this it is necessary to remove the weight bar 20 from the weight bar holder 100. The weight bar holder 100 can then be lifted and angled or tilted, as shown in FIGS. 12 and 14, to remove the engagement member 108 from the slot 18. In the tilted orientation of FIGS. 12 and 14 the weight bar holder 100 can slide up and down along the length of the upright 16 to a desired position. At the new position, the user inserts the engagement member 108 into the respective slot 18 and rotates the weight bar holder 100 back to the orientation shown in FIGS. 11 and 13. The retainer 106, sidewalls 112 and front wall 110, as well as the angle of the engagement member 108 relative to the bottom edge of the slot 18, tend to bring the weight bar holder 100 into a proper orientation with respect to the riser 16 once the user inserts the engagement member 108 within the desired slot 18. With the weight bar holder 100 once again securely and stably positioned on the upright 16 as shown in FIGS. 11 and 13, the weight bar 20 can be placed within the bar support member 104 of the weight bar holder 100, and the exercise devise is ready for use.

Figure 19:
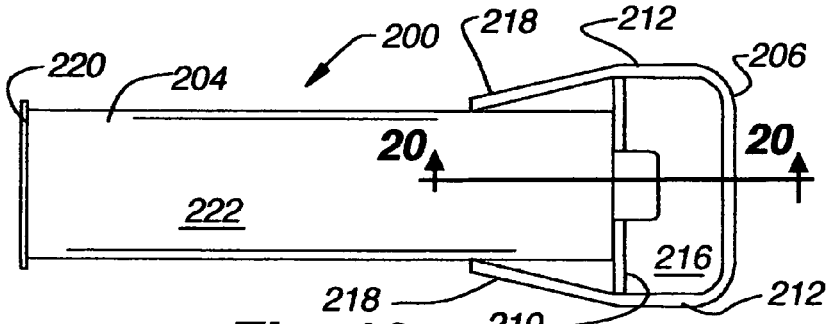
FIG. 19 is a top plan view of the spotter of FIG. 15.
Figure 20:
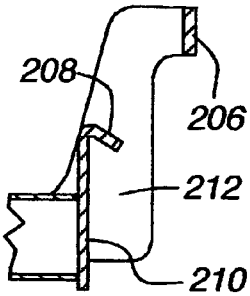
FIG. 20 is a partial cross sectional view of the spotter of FIG. 15 taken along line 20-20 of FIG. 19.

FIGS. 15-20 illustrate a weight bar spotter 200 according to another embodiment of the present invention. The weight bar spotter 200 shown in FIGS. 15-20 is configured with a body 202, retainer 206, and engagement member 208 in a similar form to the body 102, retainer 106, and engagement member 108 of the weight bar holder 100 described above with reference to FIGS. 1-5. The body portion 202 includes a front wall 210 and a pair of sidewalls 212 that extend generally forwardly and rearwardly perpendicularly to the front wall 210 from opposing edges of the front wall 210. The retainer 206 spans between and connects an upper rearward portion of the sidewalls 212 and is located generally above and in a parallel orientation to the front wall 210. Accordingly, as best seen in FIG. 19 a cavity, or passageway 216, for receiving a riser or upright is formed between the front wall 210, sidewalls 212, and retainer 206. The engagement member 208, in the form of a rectangular tab, extends downwardly at an angle into the passageway 216 from the upper edge of front wall 210.

An elongated support bar 204 extends generally forwardly from the front wall 210. A pair of flanges 218 or gussets extend between the sidewalls 212 and the sides of the elongated support bar 204 to support and fasten the elongated support bar 204 to the front wall 210. A bar catch in the form of an end plate 220 is provided on the distal end of the elongated support bar 204. The end plate 220 extends above the top, or bearing surface 222 of the elongated support bar 204 in order to prevent a weight bar from rolling off the distal end of the spotter 200.

In the embodiment shown, the elongated support bar 204 has a rectangular tubular cross section. Other shapes and structures may be used to form the elongated support bar 204, such as a solid rod or tube of any of a variety of cross sections. Similarly, the bar catch 220 may be formed by any of a variety of structures that extend above the bearing surface 222 with sufficient height and strength to prevent a weight bar from rolling off of the bearing surface 222.

The components of the spotter 200 may be formed from any suitable rigid, durable material including most preferably metal, such as hardened steel or aluminum. The retainer 206, sidewalls 212 and flanges 218 may be cut from a single sheet of metal and bent to the desired shape. The front wall 210 and engagement member 208 may also be formed from a single sheet of metal cut to shape and bent to the desired formation. The two metal pieces may then be joined together through conventional means such as welding, or other suitable methods, and the elongated support bar 204 can similarly be fastened to the front wall 210 and flanges 218 by welding, bolting, or other suitable manners. The engagement member 208 need not be centered laterally on the top edge of the front wall 210 as shown in the embodiment, but may be offset to either side in order to match apertures formed in an upright on which the weight bar spotter 200 is mounted. Similarly, it should be understood that the engagement member 208 could be mounted to extend inwardly and downwardly into the passageway 216 off of the retainer 206 rather than the front wall 210. The shown configuration with the engagement member 208 located on the front wall 210 is preferred as the spotter 200 will generally be adjusted from the front of the upright and it is advantageous for a user to be able to see the slots into which the engagement member 208 will be inserted. Also, while not shown in the embodiment of FIGS. 15-20, the side facing surfaces of the retainer 206 and front wall 210 may be provided with gripping pads to prevent metal on metal contact between the safety stop and the upright on which it is mounted, and to provide additional frictional support to hold the spotter 200 in place on the upright.

Figure 21:
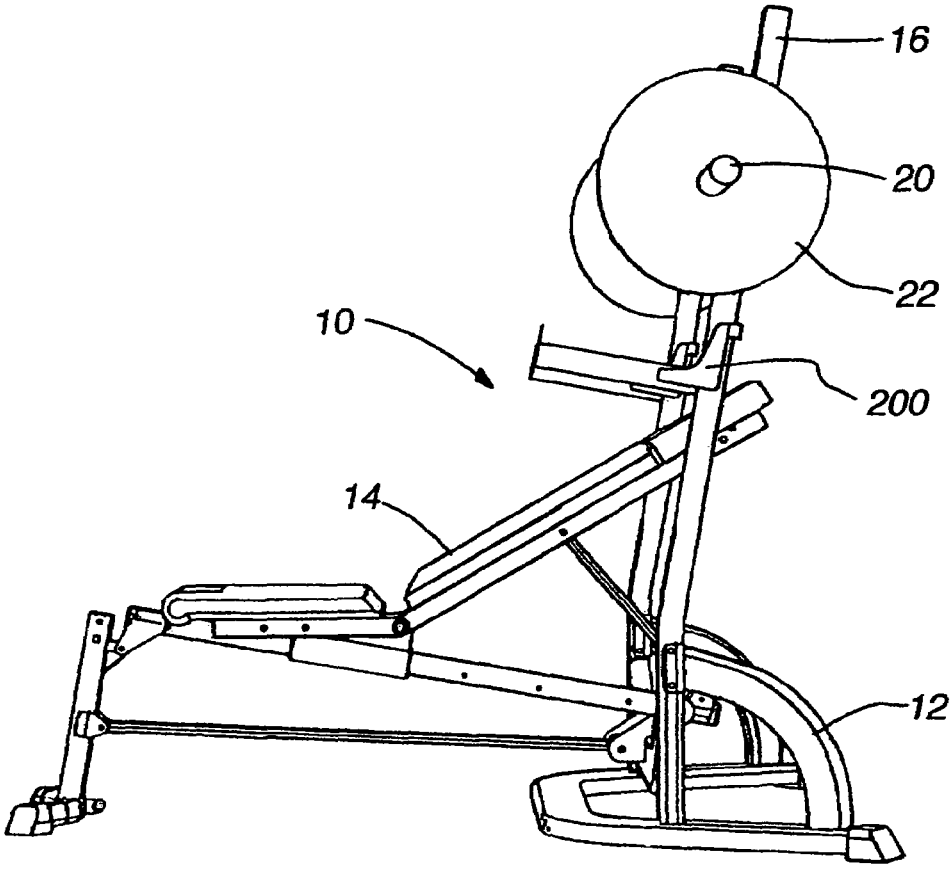
FIG. 21 is a right side perspective view of a weight bench according to one embodiment of the present invention incorporating a spotter according to FIG. 15.

FIG. 21 shows a weight bench 10 according to one embodiment of the present invention that incorporates a spotter 200 of similar design to that shown in FIGS. 15-20. The weight bench 10 includes a frame 12 with an adjustable bench 14 that is commonly adjustable between a flat reclined position and several inclined positions. Uprights 16 are supported by the frame 12 and extend generally vertically along each side of the adjustable bench 14 in order to support a weight bar 20 including weight plates 22 above a user seated or reclined on the bench 14. Weight bar spotters 200 are provided on the uprights 16. The spotters 200 are adjustable up and down along the length of the uprights 16 in a slidable fashion. The uprights 16 include slots 18 (not shown in FIG. 21) that can be engaged by engagement members 208 to set the safety stops at a desired position on the uprights 16.

Figure 22:
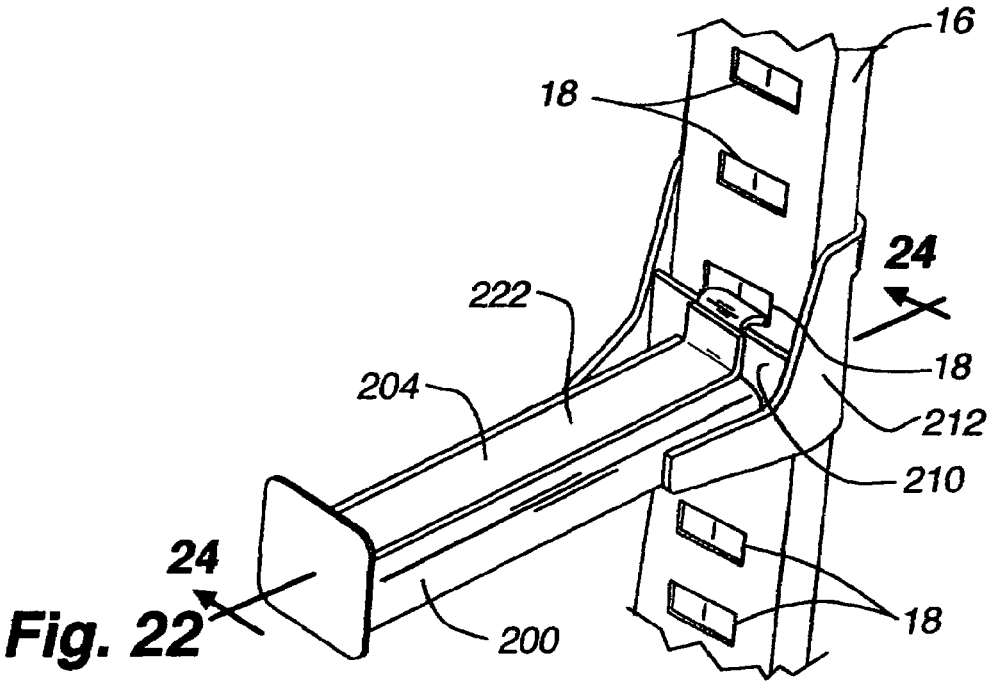
FIG. 22 is a partial perspective detail of an upright and spotter from the weight bench of FIG. 21 with the spotter in an engaged spotting configuration.
Figure 24:
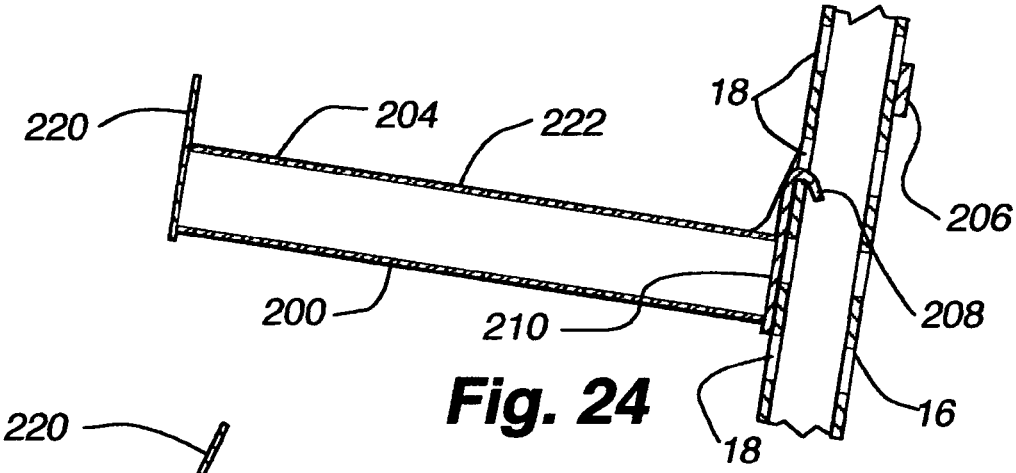
FIG. 24 is a cross sectional view of the upright and spotter of FIG. 22 taken along line 24-24 of FIG. 22.

Preferably the spotters 200 will be set at a height such that if a user performing repetitions on the bench 14, for example a bench press, is too fatigued to elevate the weight bar 20 all the way up to the storage location (for example up to a weight bar holder 100 not shown) the user may lower the weight bar 20 onto the spotters 200 while still having space between the user's body and the weight bar 20 such that the user may safely dismount from the weight bench 10, or, if the user should inadvertently drop or otherwise lose a grip upon the weight bar 20 during repetitions, the spotter 200 will catch the weight bar 20 and prevent it from falling onto the user, potentially causing injury. Therefore, it is important during use of the bench 100 to appropriately adjust the spotter 200 to an appropriate height. The spotter 200 can thus serve as a redundancy, or substitute for, a human spotter. FIGS. 22 and 24 illustrate the engaged working position of a spotter 200 on a portion of a riser 16. In this engaged configuration the bottom surface of engagement member 208 rests upon the top edge of a slot 18 formed in the front face of riser 16. The spotter 200 interacts with the riser 16 in a similar fashion to that shown and described with reference to FIGS. 11-14 in regards to the weight bar holder 100. As seen in FIG. 24 the front wall 210 rests squarely against the front face of the riser 16, and the inner surface of the retainer 206 rests against the back surface of the upright 16. Friction between the riser 16 and the front wall 210 and retainer 206 provides additional support to the engagement member 208 to maintain the spotter 200 in place. As noted above, the front wall 210 and retainer 206 may be provided with high friction gripping pads to enhance the frictional support provided by those structures. When a downward force is supplied upon the elongated support bar 204, for example by a weight bar resting on the bearing surface 222, it creates a moment on the spotter 200 that serves to further press the front wall 210 and retainer 206 firmly against the upright 16.

Figure 23:
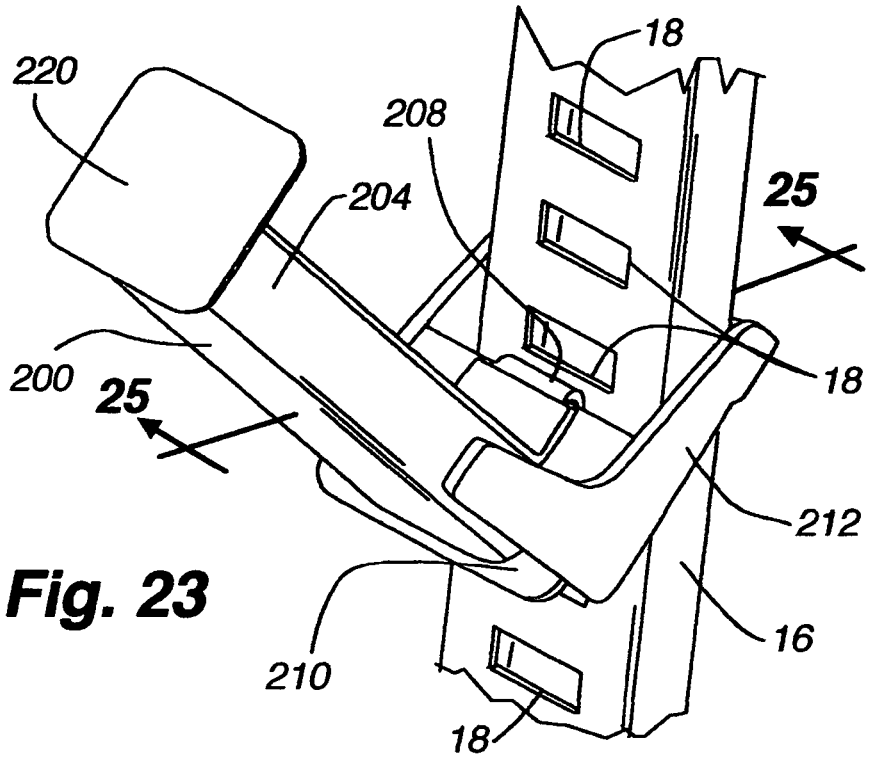
FIG. 23 is a partial isometric detail of an upright and spotter from the weight bench of FIG. 21 with the spotter tilted into an adjustable configuration.
Figure 25:
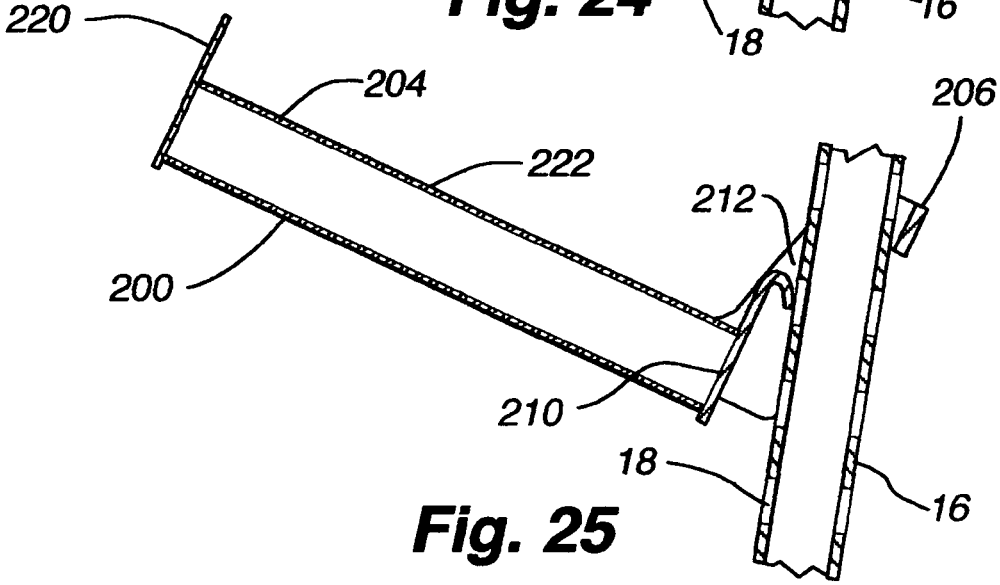
FIG. 25 is an isometric view of the upright and spotter of FIG. 23 taken along line 25-25 of FIG. 23.

In order to adjust the spotter 200 to a different location upon the riser 16 it is necessary to remove the weight bar 20 from the elongated support bar 204. The spotter 200 may be lifted and rotated until the engagement member 208 is completely withdrawn from the slot 18 as shown in FIGS. 23 and 25. In the tilted orientation shown in FIGS. 23 and 25 the spotter 200 is free to slide up and down along the length of the riser 16 to a desired new positions. At the new position, the user may insert the engagement member 208 into the desired slot 18 and then rotate and lower the spotter 200 back to the position shown in FIGS. 22 and 24. The downward angle of the engagement member 208 relative to the front wall 210 serves to guide and urge the safety spotter 200 into the engagement position of FIGS. 22 and 24 if the spotter 200 should get jostled or bumped slightly out of position. It may be desired to use a relatively longer engagement member 208 in the spotter 200 as compared to the weight bar holder 100 as the spotter 200 is more likely to be subjected to significant impact loading from dropped weight bar 20, and because of the potentially larger torque that may be placed upon the structure because of the length of the elongated support bar 204. For this reason it may also be necessary to form the parts of the safety spotter 200 from relatively heavier or more robust material than the weight bar holder 100.

Figure 26:
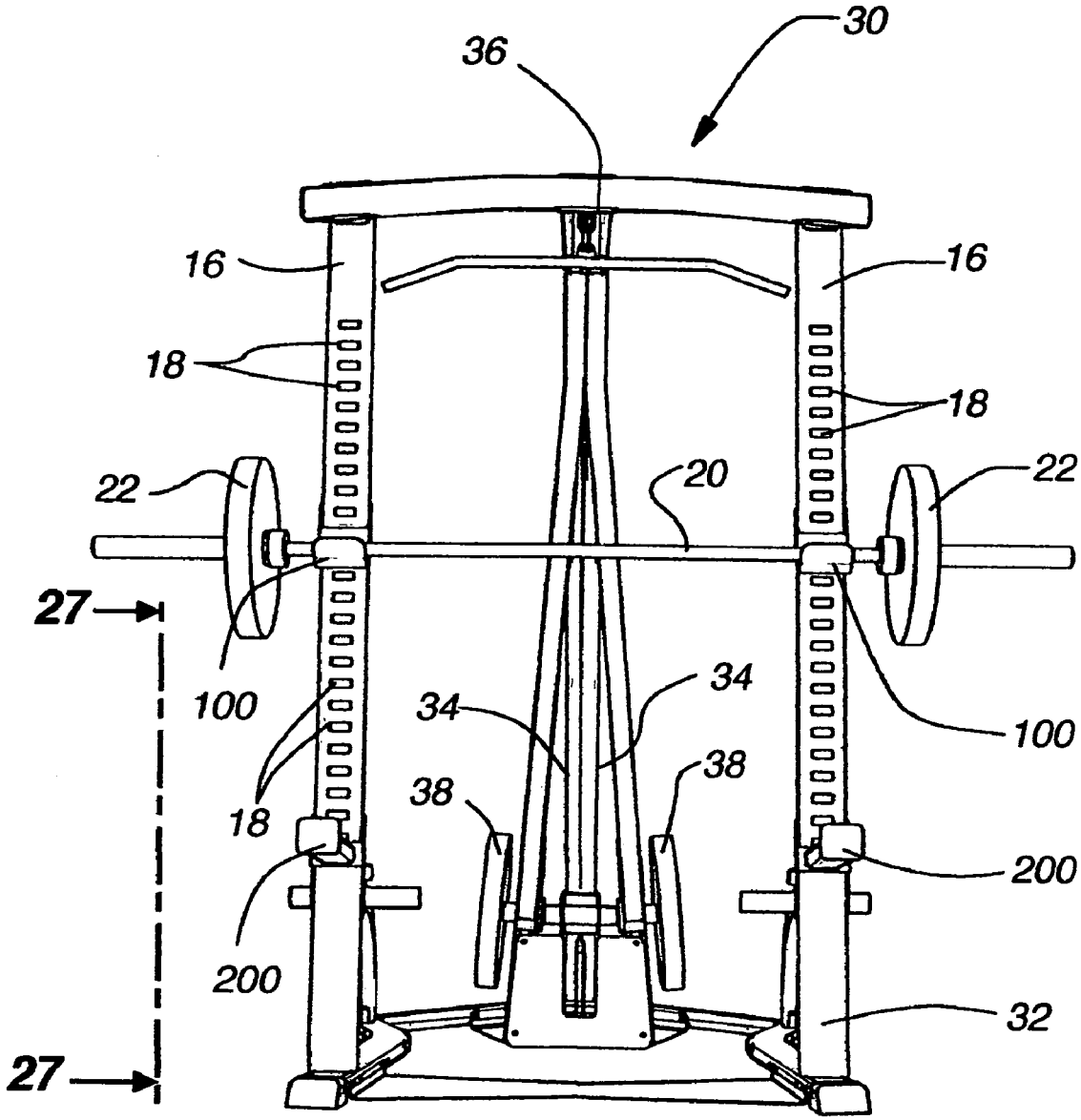
FIG. 26 is a front elevation view of a half-cage weight rack according to one embodiment of the present invention incorporating spotters according to the embodiment of FIG. 15.
Figure 27:
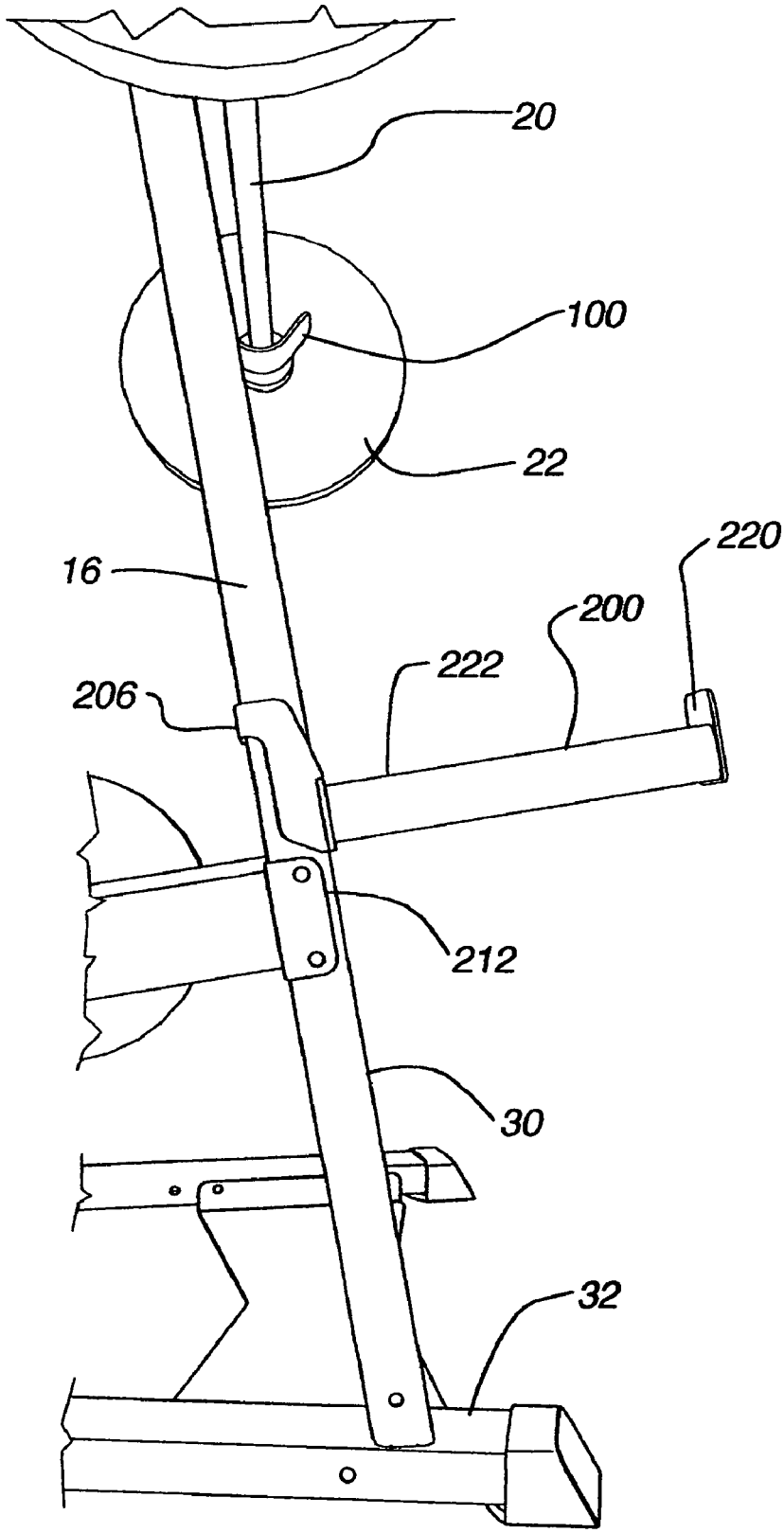
FIG. 27 is a partial perspective view of the half-cage weight rack of FIG. 26 taken along line 27-27 of FIG. 26.
Figure 28:
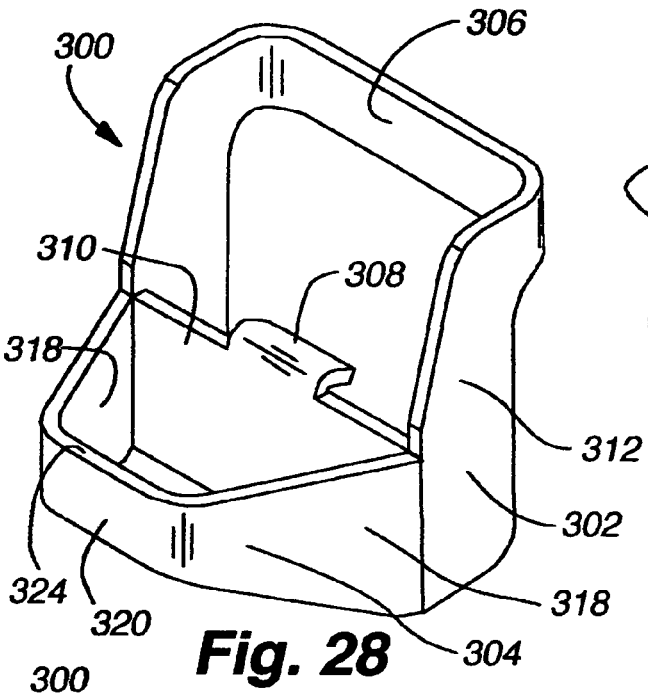
FIG. 28 is an isometric view of a safety stop according to one embodiment of the present invention.
Figure 29:
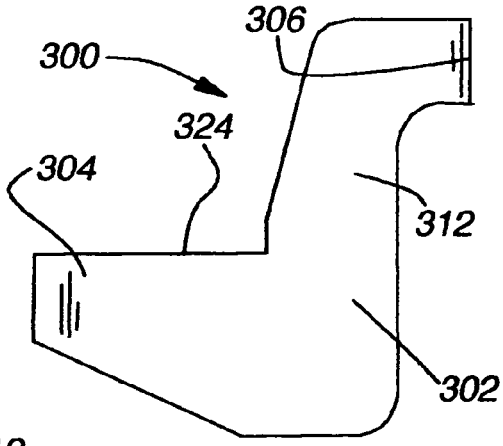
FIG. 29 is a right side elevation view of the safety stop of FIG. 28.
Figure 30:
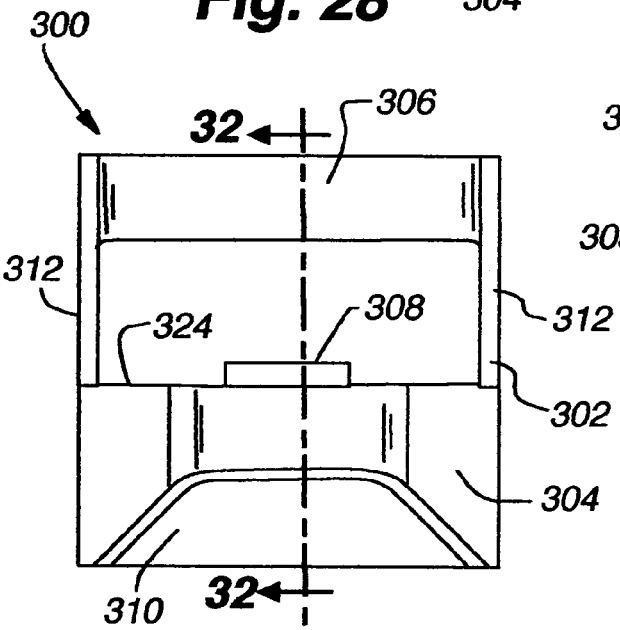
FIG. 30 is a front elevation view of the weight stop of FIG. 28.
Figure 31:
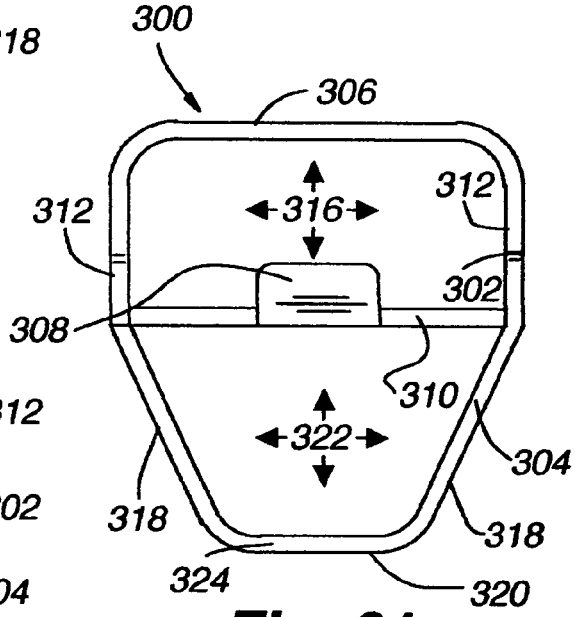
FIG. 31 is a top plan view of the safety stop of FIG. 28.
Figure 32:
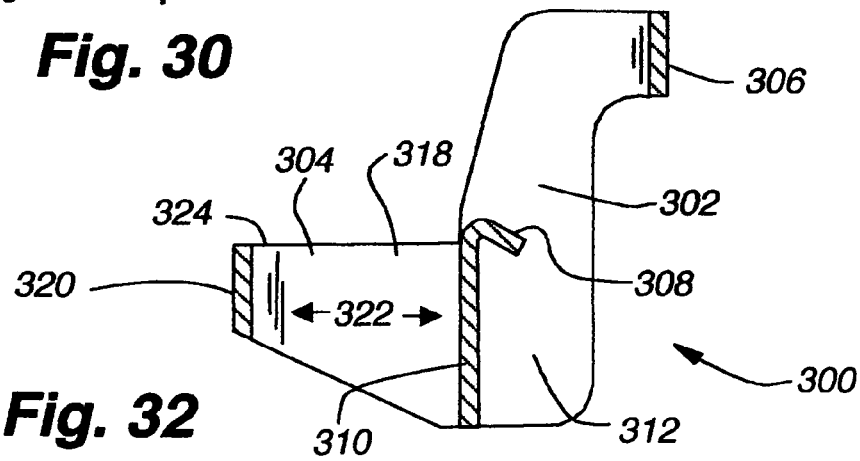
FIG. 32 is a cross sectional view of the safety stop of FIG. 28 taken along line 32-32 of FIG. 30.

FIGS. 26 and 27 illustrate another exercise machine in the form of a half-cage weight machine 30 that incorporates spotters 200 according to one embodiment of the present invention. The half-cage weight machine 30 includes a frame 32 that supports cables 34 and pulleys 36 attached to weight stacks 38 for performing various exercises. A pair of uprights 16 including a plurality of vertically spaced apertures 18 are also supported by the frame 32. Weight bar holders 100 are provided on the risers 16 and are used to support a weight bar 20 provided with weight plates 22. Also provided on the risers 16 at a location below the weight bar holders 100 are spotters 200 consistent with the embodiment shown in FIGS. 15-25. The spotters 200 serve as spotters to capture and retain weight bar 20 in case a user is unable to return it to the weight bar holders 100, or in case a user loses his or her grip on the weight bar 20. For example, a user performing bicep curls using the half-cage 30 might stand generally between the two spotters 200 facing towards the half-cage 30. The spotters 200 should be adjusted on the risers 16 such that they are at, or just slight below, the bottom most position of the weight bar 20 during the repetitions. If a user is unable to return the weight bar all the way back up to the level of the weight bar holder 100 at the conclusion of the repetitions of curls, for example because of excessive fatigue, the user may set the weight bar 20 onto the spotters 200, and then return the weight bar 20 to the weight bar holders 100 after a period of rest. Similarly, if the weight bar 20 should happen to slip from the users hands while performing the curls, the spotters 200 should catch the falling bar 20 and prevent it from falling upon and injuring the user. If the spotter 200 is adjusted too high upon the risers 16 it will interfere with the range of motion of the desired exercise, for example, the curl. If the spotter 200 is set unnecessarily low upon the risers 16, the spotter 200 may be subjected to excessive and unnecessary forces due to the momentum gained by a falling weight bar 20. Therefore, it is important for a user to adjust the spotter 200 to an appropriate height.

As seen in FIG. 27 it is preferable for the elongated support bar portion 204 to be inclined slightly so that a weight bar 20 will be urged towards the risers 16 where it can most efficiently be retained, and where it is not likely to fall off the end of the spotter 200. The end plate 220 extends above the bearing surface 222 and further serves as a retaining lip to maintain the weight bar 20 on the spotter 200. The incline of the elongated support bar 204 is achieved naturally on machines where the riser 16 is inclined. Alternatively, the incline can be built into the spotter 200 itself by adjusting the angle of the elongated support bar 204 relative to the front wall 210, if the spotter 200 will be used on non-inclined uprights 16.

FIGS. 28-32 illustrate a safety stop 300 that is adapted for use with exercise machines utilizing a weight bar that is attached to a shuttle that moves along a guide bar, such that the weight bar is constrained to move along a fixed path. Such exercise machines include devices commonly known as "Smith racks." The safety stop 300 shares many features similar to the weight bar holder 100 of FIGS. 1-5, including a body 302, a retainer 306, and an engagement member 308. The body 302 is formed by a front wall 310 and sidewalls 312 that extend generally rearwardly and perpendicularly from opposing side edges of the front wall 10. The retainer 306 connects and spans across the top rear portion of the sidewalls 312 at a position above and generally facing and parallel to the front wall 310. Therefore, a cavity or passageway 316 is defined and formed by the inwardly facing surfaces of front wall 310, sidewalls 312, and retainer 306. This passageway 316 is adapted to receive a riser or upright associated with the guide bars of a Smith rack.

An outwardly extending support member 304 extends generally forwardly from the front wall 310. The support member 304 in the present embodiment is formed by a pair of tapered angular walls 318 that are connected at their forward most ends by an end wall 320. Therefore, a second passageway 322 is formed and defined by the facing surfaces of the front wall 310, the tapered angular walls 318 and the end wall 320. The second passageway 322 is adapted to receive the guide bar portion of a Smith rack. The top edges of the tapered angular walls should preferably extend perpendicularly relative to the front wall 310. These top edges of the tapered angular walls 318 along with the top edge of the end wall 320 form a bearing surface 324 against which the shuttle portion of the Smith rack may be supported. While not shown in the drawings, it should be understood that the facing surfaces of the front wall 310 and the retainer 306 may be provided with gripping pads in a similar fashion to the weight bar holder 100 of FIGS. 1-5.

Engagement member 308 is provided in the form of a downwardly angled tab extending from the top edge of the front wall 310 into the passageway 316. As discussed above, the size, angle and shape of the engagement member 308 may be varied to suit the intended purpose. Additionally, the engagement member 308 need not, necessarily, be located at the top edge of the front wall 310, but could be extended off of a lower portion of the front wall 310. Similarly, it may be possible, though less advantageous, to extend the engagement member 308 into the passageway 316 off of the retainer 306, rather than off of the front wall 310.

Figure 33:
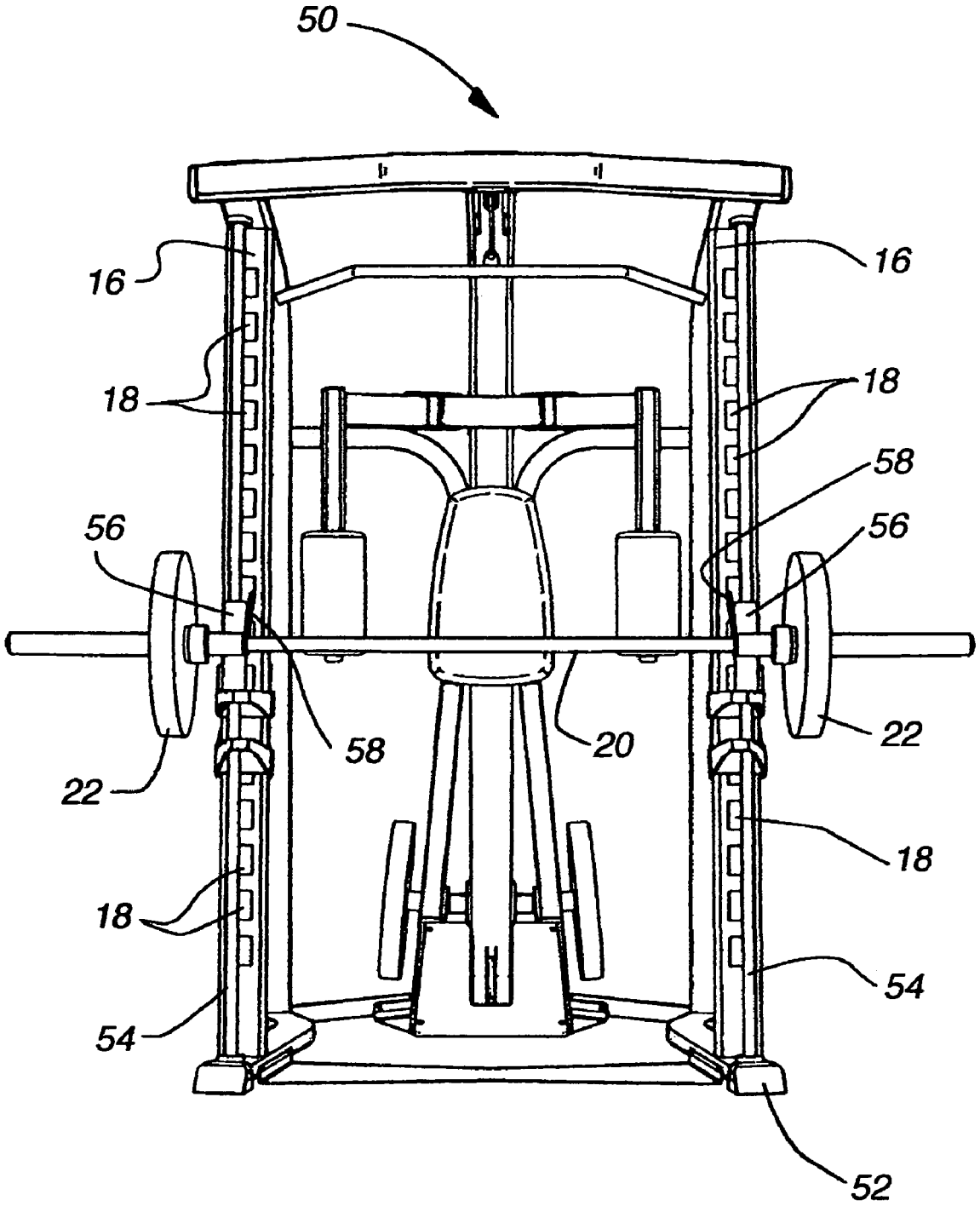
FIG. 33 is a front elevation view of a Smith machine weight rack according to one embodiment of the present invention that incorporates safety stops according to the embodiment shown in FIG. 28.

FIG. 33 shows an embodiment of an exercise machine in the form of a Smith rack 50 according to one embodiment of the present invention that incorporated safety stops 300 according to the design shown in FIGS. 28-32. The Smith rack 50 includes a frame 52 that supports uprights 16 and associated guide bars 54. The uprights 16 are provided with a plurality of apertures or slots 18 along their length. The guide bars 54 are provided in close proximity in front of and parallel to the uprights 16. Slidable collars in the form of shuttles 56 are slidably journaled onto the guide bars 54, and a weight bar 20 is attached to the shuttles 56. Therefore, the weight bar 20 is confined to move only in combination with the shuttles 56 along the path defined by guide bars 54. Hooks or latches 58, engage slots 18 to retain the weight bar 20 in place on the uprights 16, when not in use. Safety stops 300 are adjustably mounted at a desired height on the uprights 16 by insertion of the engagement members 308 into a desired slot 18. The shuttles 56 rest upon and are supported by the bearing surface 324 of safety stops 300 in engagement with the risers 16. In the embodiment shown in FIG. 33, two such safety stops 300 are provided on each riser 16 for illustration purposes. In practice, a single safety stop 300 would be mounted on each riser 16.

In use, the safety stop 300 is adjusted to a desired height along the riser 16, in a fashion that will be described in further detail below. Typically this height will be at or slightly below the lowest extreme in the range of motion for a given exercise. For example, if the Smith rack 50 was going to be used to perform squats, the safety stops 300 should be set at a height such that when a user is at the bottom of his or her squat the bottom of the shuttle 56 lightly contacts, or sits slightly above, the bearing surface 324 of the safety stop 300. Therefore, when a user has completed his or her repetition of squats, they may gently set the shuttles 56 onto the safety stops 300 and exit the apparatus. The safety stops 300 can also act as a restrictive device to prevent a user from extending the range of motion beyond a safe or desired extent in order to prevent injury or focus the workout on a desired range of motion.

Figure 34:
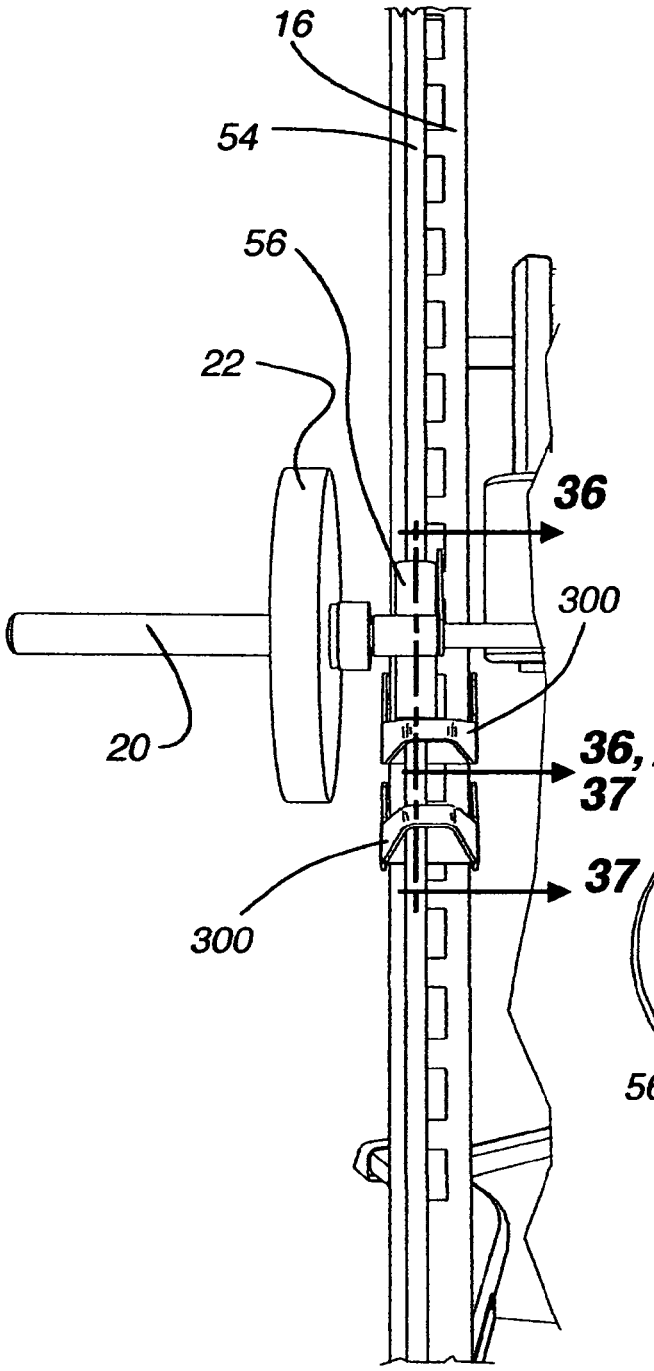
FIG. 34 is a partial detail view of a riser and a pair of safety stops according to the embodiment of FIG. 33 with the top safety stop in a spotting configuration and the bottom safety stop in a tilted adjusting configuration.
Figure 35:
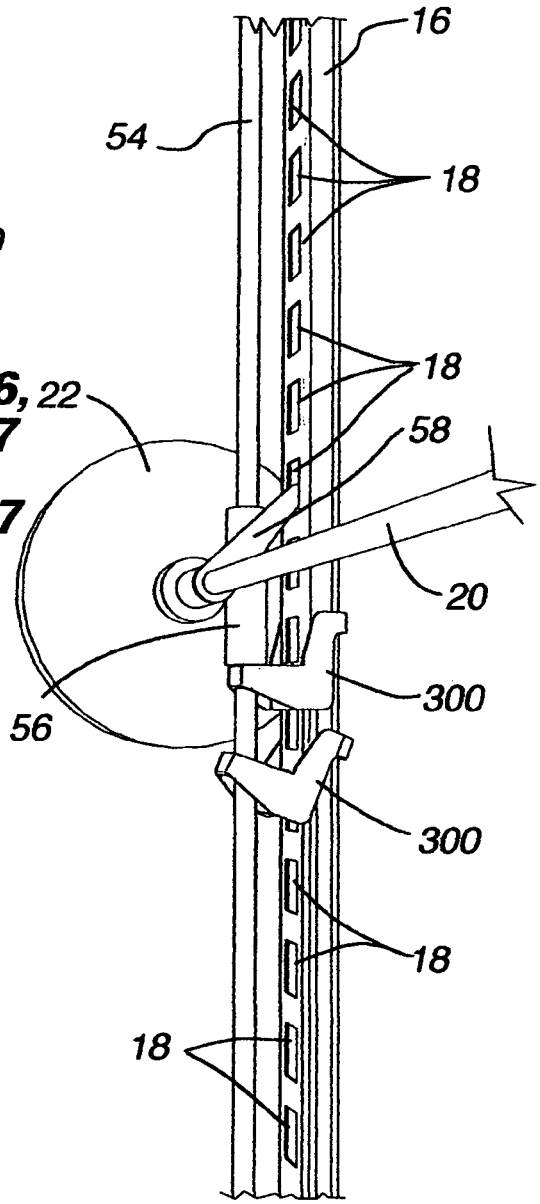
FIG. 35 is a partial perspective detail of a riser and safety stop is of the Smith machine of FIG. 34.
Figure 37:
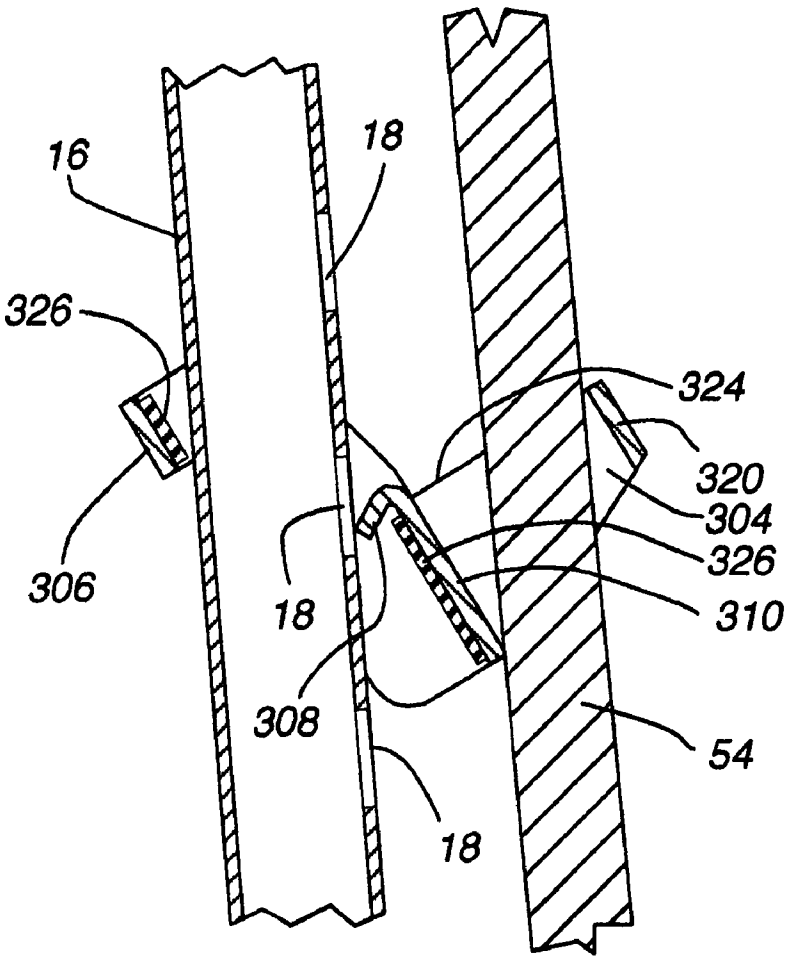
FIG. 37 is a partial cross sectional view of the riser and bottom safety stop of FIG. 35 taken along line 37-37 of FIG. 35.

FIGS. 34 and 35 show details of a left riser portion of the Smith rack 50 from FIG. 33. In these figures, the top safety stop 300 is shown in an engaged position, while the lower safety stop 300 is shown in a disengaged adjustable position. The upper safety stop 300 in the engaged position is shown in cross section in FIG. 36; whereas the lower safety stop 300 in a disengaged adjustable position is shown in cross section in FIG. 37.

A pair of latches or hooks 58 are securely attached to the weight bar 20 such that as a user rotates the weight bar 20 the user can control whether the latches 58 engage or disengage within the apertures 18 of the uprights 16. The safety stops 300 provide a redundancy, and an emergency safety stop in the event that a user is unable to secure the latches 58 within the apertures 18 when the exercise is complete. During use, the user elevates the weight bar 20, and rotates the weight bar 20 so that the latches 58 disengage from the apertures 18 of the uprights 16. The user then performs the number of repetitions desired for the exercise, and rotates the weight bar 20 so as to position the latches 58 within the apertures 18 so that the weight bar 20 and weight plates 22 attached thereto are securely positioned within the Smith rack 50. However, if the user is unable to successfully secure the latches 58 the safety stops 300 act as a support mechanism to support and retain the shuttles 56 and weight bar 20.

Figure 36:
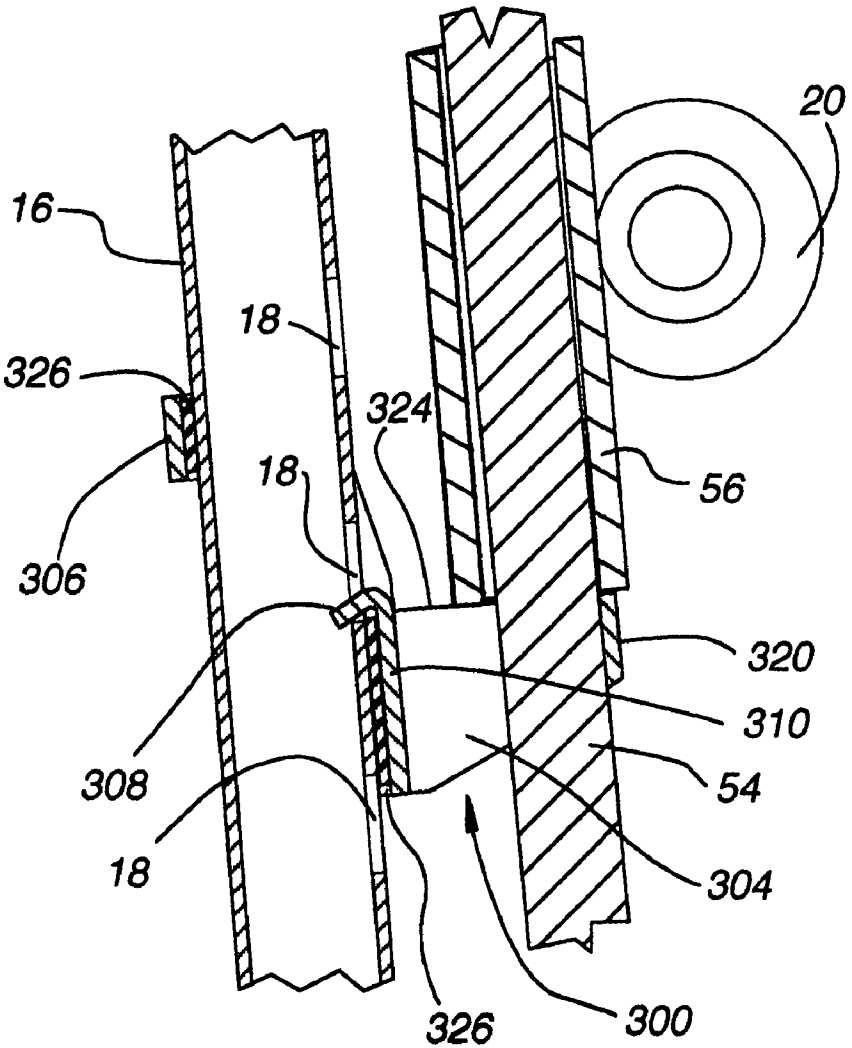
FIG. 36 is a partial cross sectional view of the riser and top safety stop of FIG. 34 taken along line 36-36 of FIG. 34.
Figure 38:
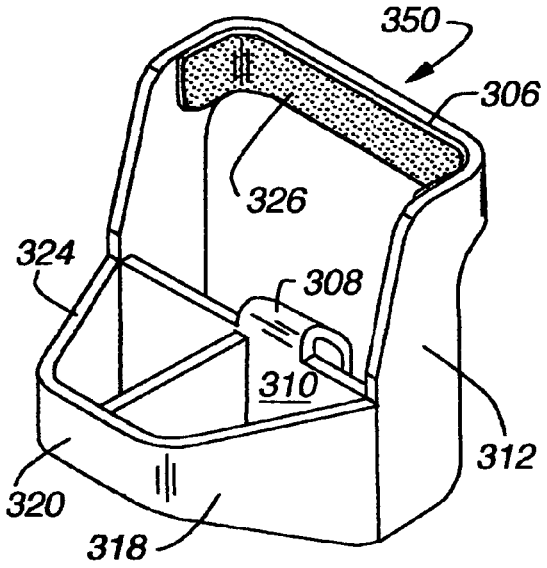
FIG. 38 is a safety stop with a right-hand offset engagement member according to another embodiment of the present invention.
Figure 39:
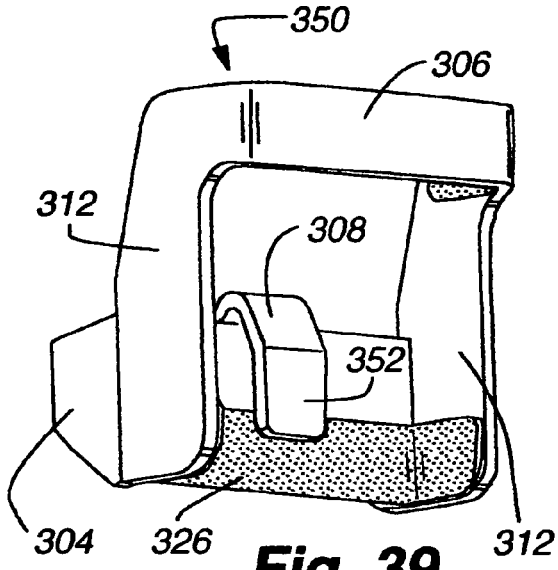
FIG. 39 is an isometric view generally from the rear of the safety stop of FIG. 38.
Figure 40:
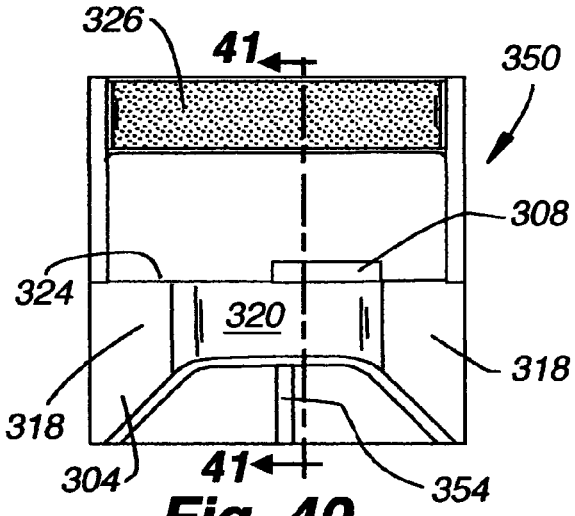
FIG. 40 is a front elevation view of the safety stop of FIG. 38.
Figure 41:
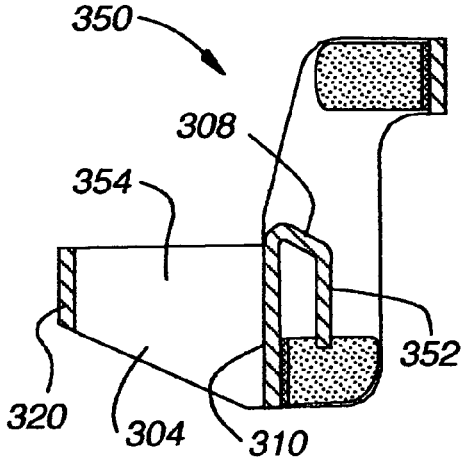
FIG. 41 is a cross sectional view of the safety stop of FIG. 38 taken along line 41-41 of FIG. 40.

With further reference to FIG. 36 it can be seen that the safety stop 300 in the engaged position has an engagement member 308 inserted into slot 18 such that the bottom surface of the engagement member 308 rests upon the top edge of the slot 18. The upright 16 is provided generally within passageway 316 oriented such that the retainer 306 presses securely against the back of riser 16 while the front wall 310 presses against the front face of the riser 16. In the embodiment shown in FIG. 36 the retainer 306 and front wall 310 are each provided with gripping pads 326 to protect against metal on metal wear, and to provide additional friction support for the safety stop 300. The guide bar 54 is received within the second passageway 322, and the shuttle 56 rests on the bearing surface 324 formed by the top edges of the tapered angular walls 318 and end wall 320 of the safety stop 300. The weight of the shuttle and weight bar 20 pressing against the bearing surface 324 tends to torque the gripping pads 326 firmly and securely against the upright 16 to hold the safety stop 300 in place.

In order to adjust the location of the safety stop 300 on the upright 16 the shuttle 56 must be lifted off the safety stop 300, and preferably is secured to the riser 16 by rotating the latches 58 into engagement with an aperture 18. The safety stop 300 may then be lifted and rotated to the position shown in FIG. 37, and by the bottom safety stop 300 in FIGS. 34 and 35. In this tilted orientation the safety stop 300 may be slid up and down along the riser 16 and guide bar 54 to a desired height. At the desired location the engagement member 308 may be inserted into the desired slot 18 and the safety stop 300 may be rotated and lowered back into the position shown in FIG. 36. The retainer 306, sidewalls 312, and front wall 310, as well as the angle of the engagement member 308 relative to the bottom edge of the aperture 18, tend to bring the safety stop 300 into a proper orientation once a user inserts the engagement member 308 into the desired slot 18.

Accordingly, it can be seen that in the event a user is unable to secure the latches 58 of the weight bar 20 of a Smith rack 50, the safety stop 300 provides an additional level of safety to prevent the shuttle 56 and weight bar 20 from downward movement beyond the position of the bearing surface 324 created by the safety stop 300. The position of the safety stops 300 on the riser 16 can be quickly and easily adjusted by a user to suit a particular exercise or user.

Figure 42:
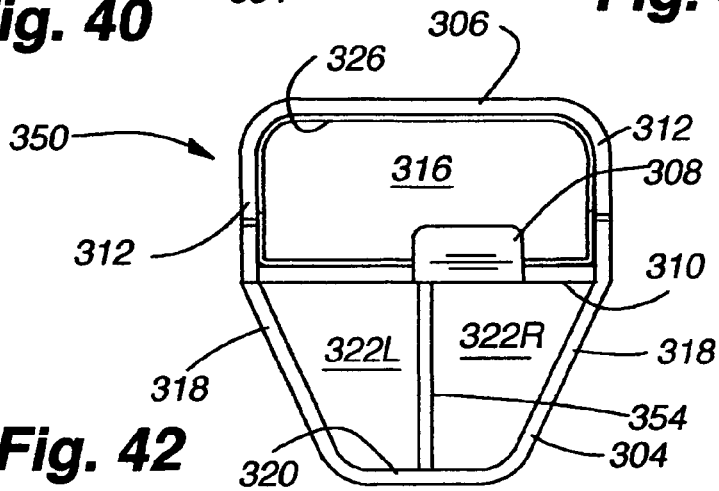
FIG. 42 is a top plan view of the safety stop of FIG. 38.
Figure 43:
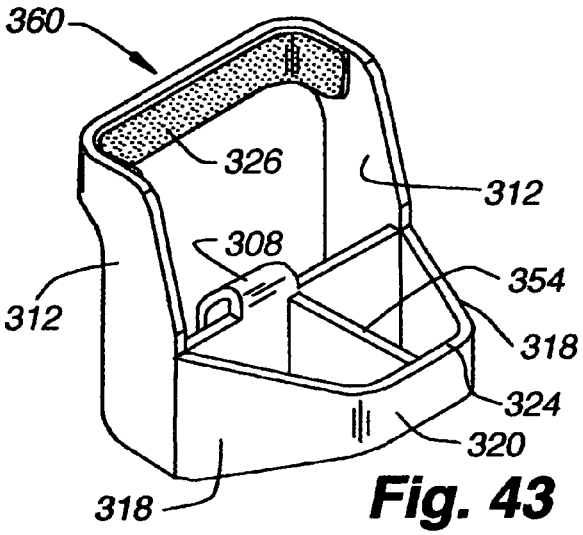
FIG. 43 is a perspective view of a safety stop with a left-hand offset engagement member according to one embodiment of the present invention.
Figure 44:
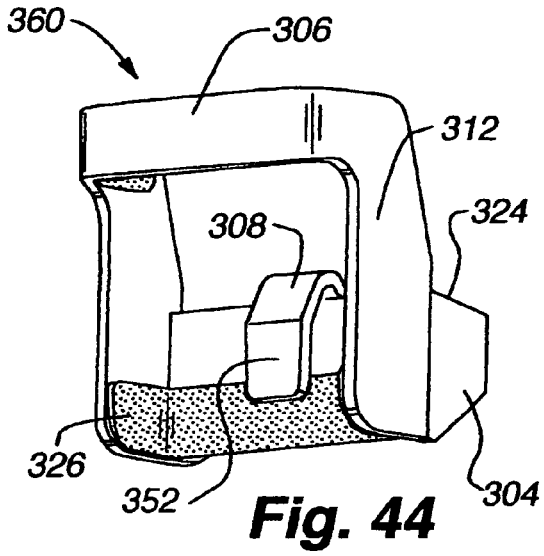
FIG. 44 is an isometric view taken generally from the rear of the safety stop of FIG. 43.
Figure 45:
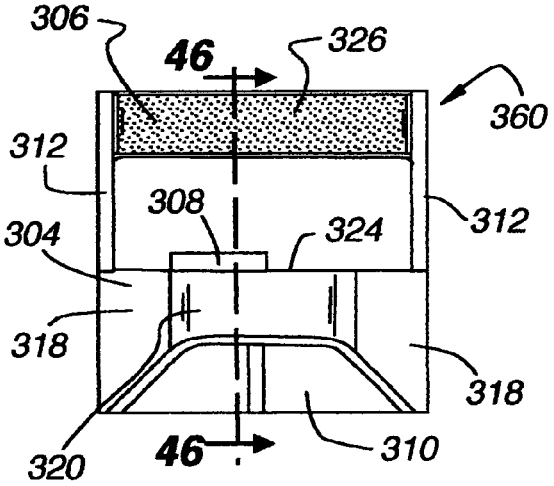
FIG. 45 is a front elevation view of the safety stop of FIG. 43.
Figure 46:
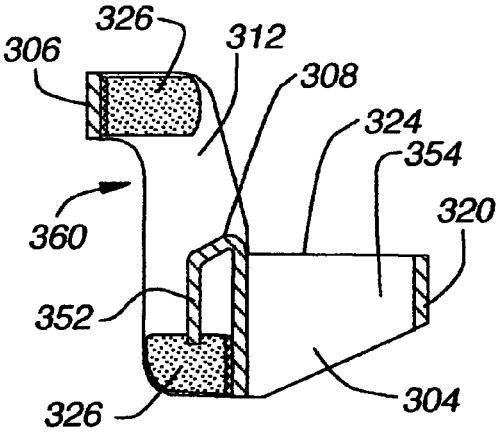
FIG. 46 is a cross sectional view of the safety stop of FIG. 43 taken along line 46-46 of FIG. 45.

FIGS. 38-42 disclose a safety stop 350 adapted for use with a Smith rack (not shown) having a riser 16 wherein the apertures 18 are offset to the right of center on the face of the upright 16. It is similar in design and function to the safety stop shown in FIGS. 28-32 with a few notable differences that will be highlighted. First, the engagement member 308 is offset to the right of center on the front wall 310 as best seen in FIG. 42. This offset location for the engagement member 308 permits it to engage the offset slots 18 on upright 16. Furthermore, an extension member 352 has been added to the engagement member 308 in order to form a longer, and compound shape engagement member 308. This elongated engagement member 308 provides a more secure connection with the upright 16 so that if the shuttle 56 is bounced against the safety stop 300, it is less likely that the engagement member 308 will slip out of the aperture 18 if the safety stop 300 bounces upward in reaction to the bounce impact by the shuttle 56.

Additionally, a support web 354 is provided between the front wall 310 and the end wall 320. This support web 354 provides additional structural integrity to the safety stop 300. Additionally, a top edge of the support web 354 is in alignment with the top edges of the tapered angular walls 318 and end wall 320, such that the top surface of the support web 354 forms part of the bearing surface 324 for supporting the shuttle 56. The support web 354 subdivides the second passageway 322 into a left 322L and right 322R passageway. Preferably, though not necessarily, the guide bar 54 will be received through the left passageway 322L, so that the engagement member 308 and slots 18 will be visible to a user, and will not be hidden behind the guide bar 54.

Figure 47:
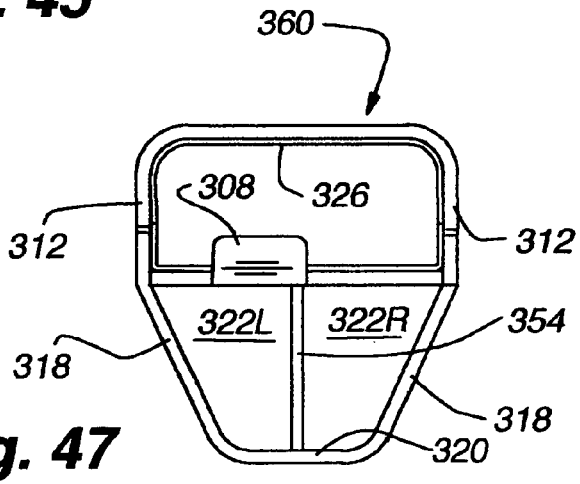
FIG. 47 is a top plan view of the safety stop of FIG. 43.

FIGS. 43-47 disclose a safety stop 360 that is the same as the safety stop 350 shown in FIGS. 38-42, except that the safety stop 360 has the engagement member 308 offset to the left of center on the front wall 310, as best seen in FIG. 47. Safety stop 360 operates similarly to safety stop 360, except it is preferred that the single bar 54 be received through the right passageway 322R.

Figure 48:
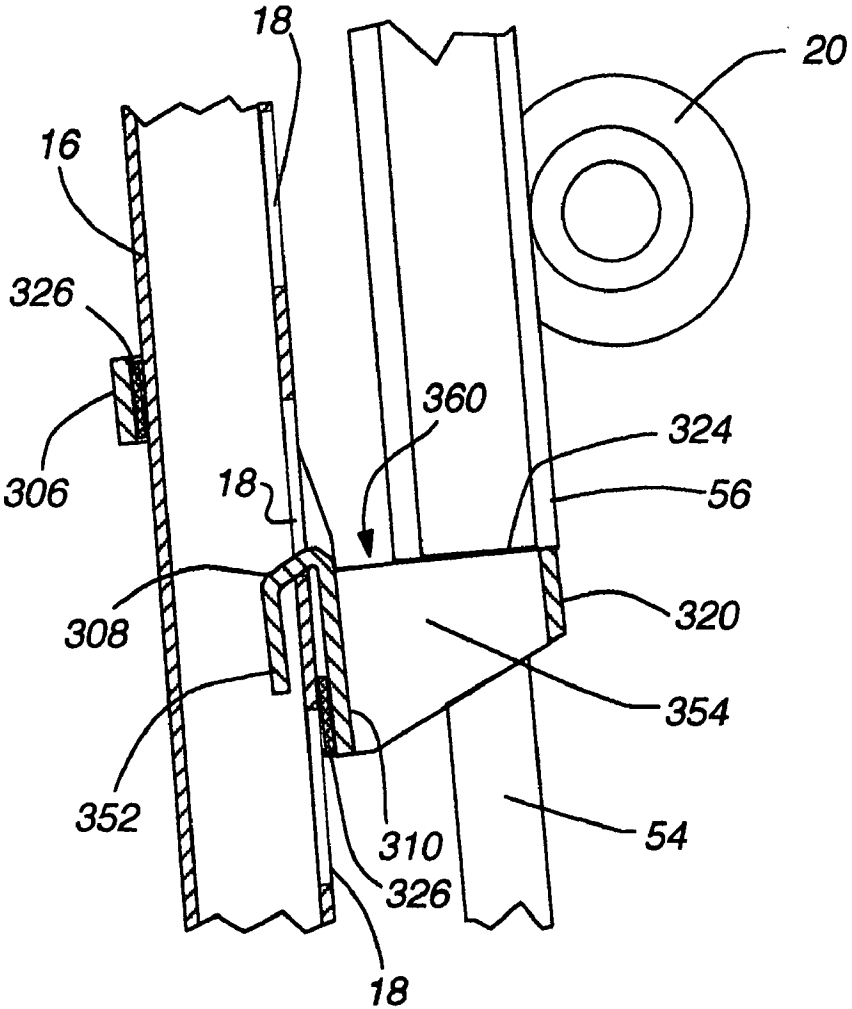
FIG. 48 is a partial cross sectional detail of a riser and safety stop according to one embodiment of the present invention utilizing a safety stop according to FIG. 38 with the safety stop adjusted to a spotting configuration.
Figures 50, 51, 52, 53, 54:
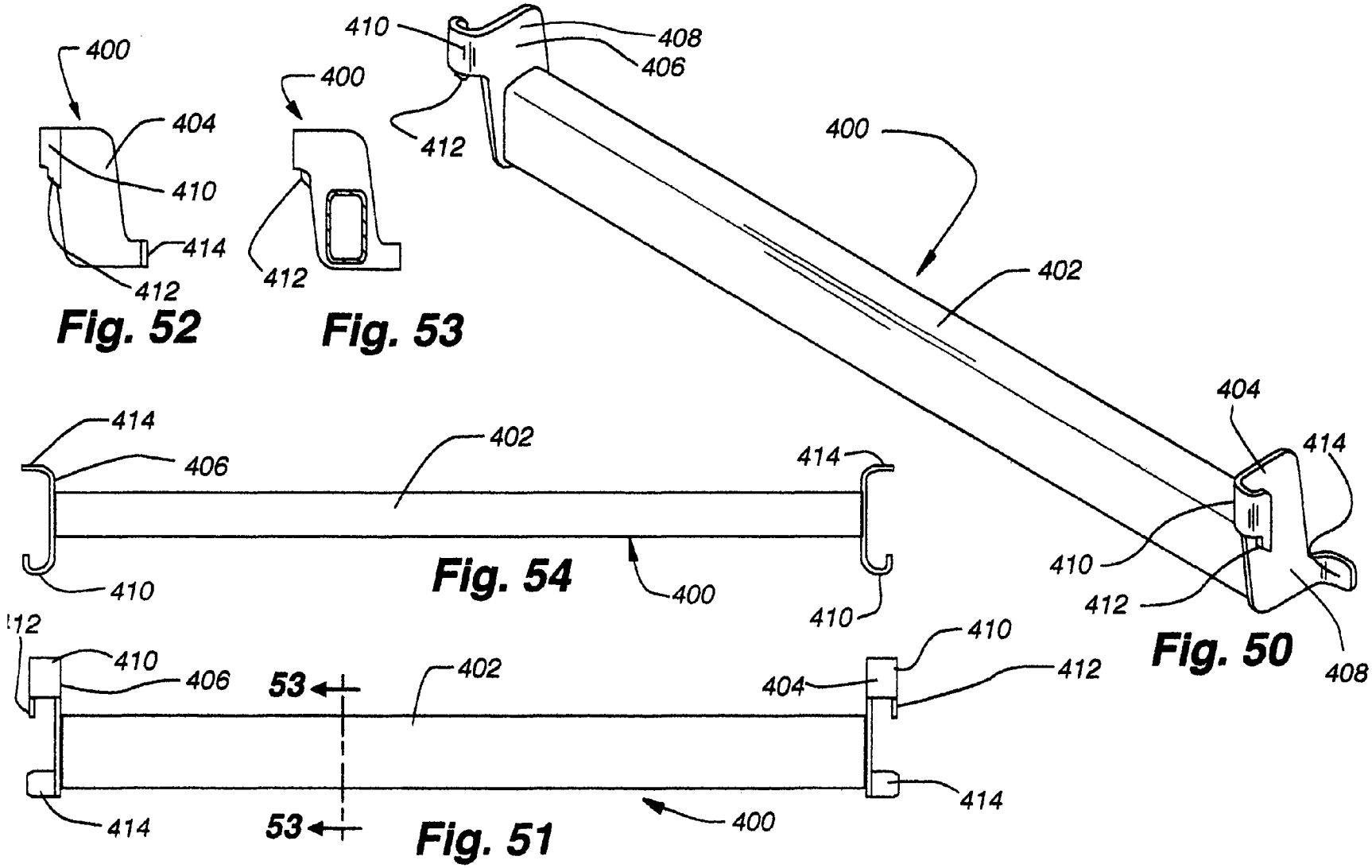
FIG. 50 is an isometric view of a spotter bar for attachment between a pair of upright members of a piece of fitness equipment according to one embodiment of the present invention.
FIG. 51 is a front elevation view of the spotter bar of FIG. 50.
FIG. 52 is a right side elevation view of the spotter bar of FIG. 50.
FIG. 53 is a cross sectional view of the spotter bar of FIG. 50 taken along line 53-53 of FIG. 51.
FIG. 54 is a top plan view of the spotter bar of FIG. 50.

FIG. 48 shows a cross sectional view of a safety stop 360 with an engagement member 308 offset to the left of center in an engaged working position on an upright 16 supporting a shuttle 56. The extension member 352 extends well below the top edge of slot 18 such that even if the stop 360 were bounced upwardly, as for example by a sharp impact by shuttle 56, the extension member 352 would still be captured within the slot 18 and the safety stop 360 would return itself to the engaged stable position of FIG. 48.

Figure 49:
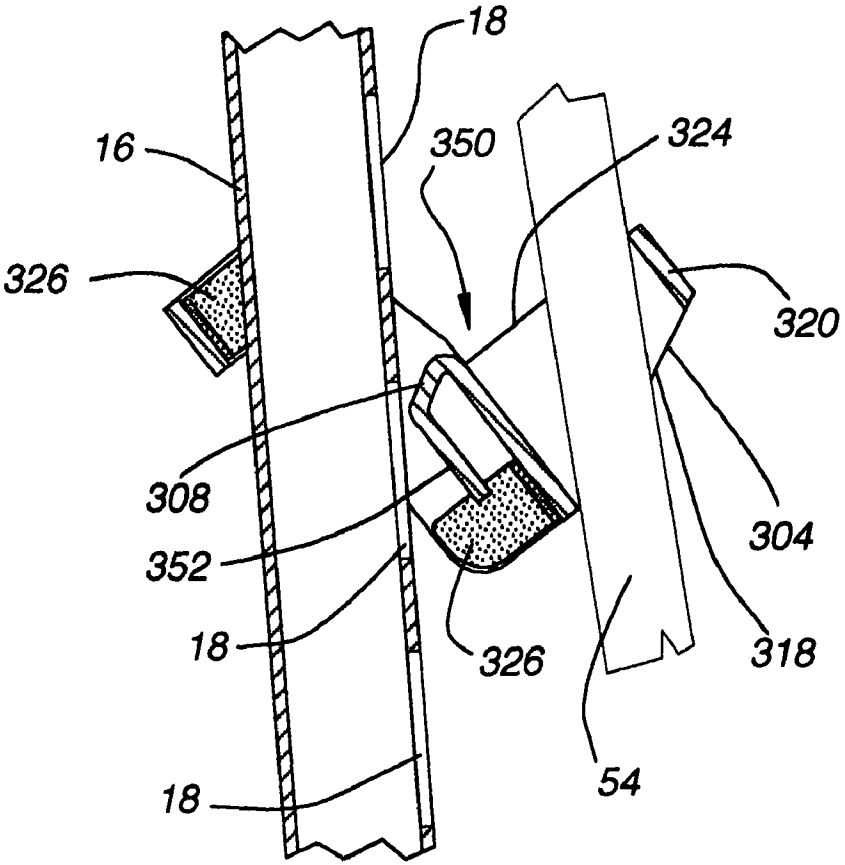
FIG. 49 is a partial cross sectional view of a riser and safety stop of FIG. 43 with the safety stop tilted to an adjustable position.

FIG. 49 shows the tilted adjustable position of a safety stop 350 with a engagement member 308 that is offset to the right of center as in FIGS. 38-42. In order to adjust the safety stop 360 to this position, it must be lifted and rotated until the entire engagement member 308, including the extension member 352 is clear from the slot 18. It should be noted that it may be necessary to form the slots 18 with a larger vertical dimension so that the extension member 352 will fit into the slots 18. Once the stop 360 is adjusted into the tilted position in FIG. 49 it can be slid up and down along the riser 16 and guide wire bar 54 to any desired location along the riser 16. The engagement member 308 can then be inserted into the desired slot 18 and the stop 360 can be rotated back to vertical and lowered into an engaged position.

FIGS. 50-54 illustrate a spotter bar 400 adapted to be coupled between two upright members or other structural elements of a piece of fitness equipment, such as a full-cage (see FIG. 55), according to another embodiment of the present invention. The spotter bar 400 includes an elongated bar support member 402 extending between a first attachment bracket 404 and a second attachment bracket 406. The first and second attachment brackets 404 and 406 are mirror images of each other. The attachment brackets 404 and 406 are adapted for attachment to upright members or risers on fitness equipment. Specifically, each attachment bracket 404 and 406 includes a main body 408 which may be in the form of a generally rectangular plate. At an upper corner of the body 408 a curved protrusion 410 extends generally outwardly away from the bar support member 402 and has a generally L-shaped cross section. This upper protrusion 410 includes a downwardly extending tab 412 with an angled tip. A lower protrusion 414 in the form of a generally rectangular tab extends generally perpendicularly from the lower corner diagonally across from the upper protrusion 410.

The bar support member 402 can be implemented using a tubular structure with a generally rectangular cross section. However, other shapes and structures can be used such as solid or hollow rods or beams of virtually any cross section. The attachment brackets 404 and 406 may be fastened to the bar support member 402 by welding, or other acceptable mechanisms.

Figure 55:
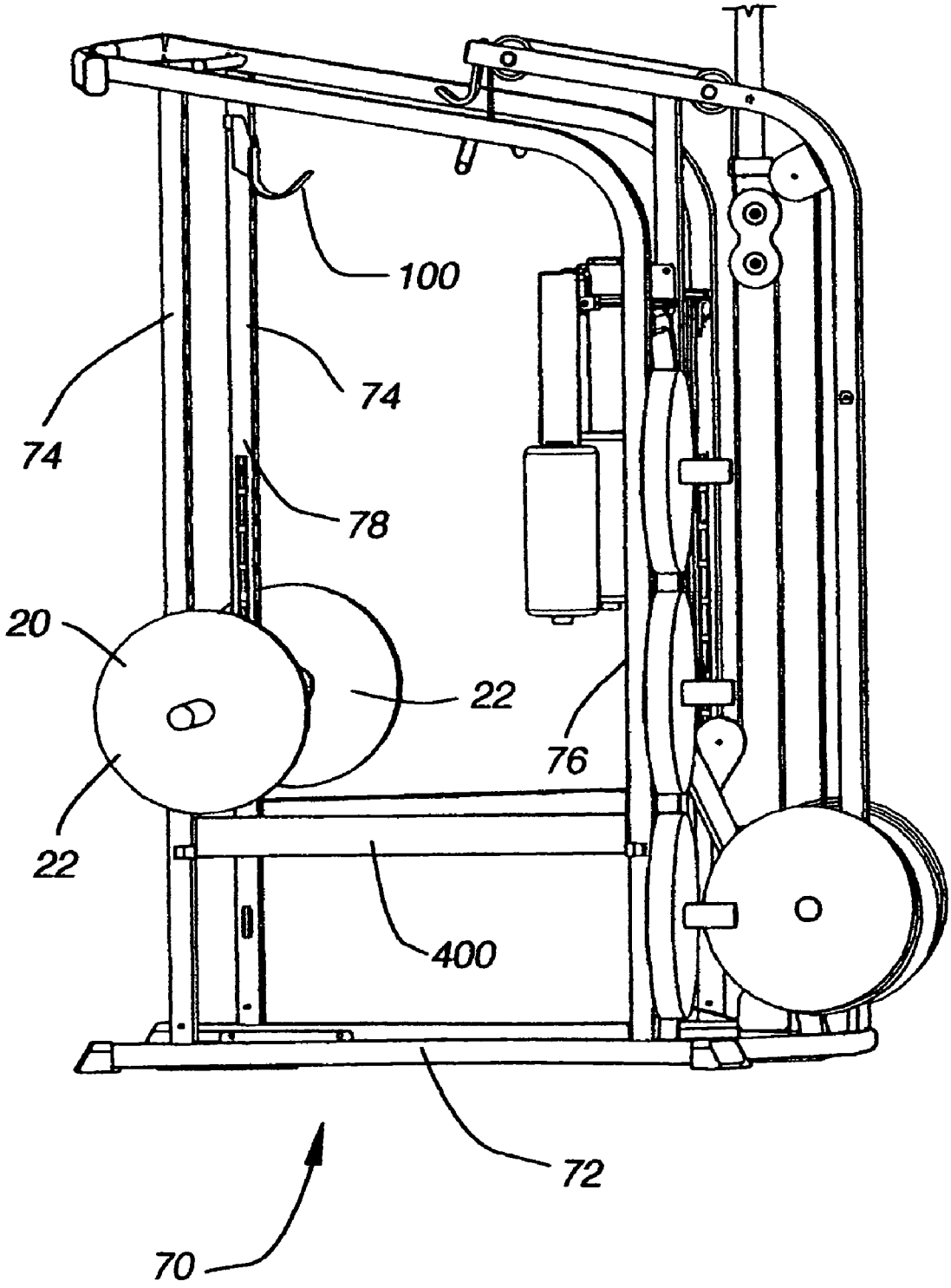
FIG. 55 is an elevation view taken generally from the right side of a full-cage weight rack according to one embodiment of the present invention incorporating spotter bars according to the embodiment of FIG. 50.

FIG. 55 shows a piece of fitness equipment in the form of a full-cage weight machine 70 that utilizes spotter bars 400 according to the embodiment shown in FIGS. 50-54. The full-cage machine 70 includes a frame 72 that supports front riser 74 and rear risers 76. The front risers 74 are provided with a first series of slots 18 on a rearward facing surface of the front riser 74, and a second series of slots 78 provided on a side surface of the front risers 74. Bar support members 100 may be provided on the front risers 74 in engagement with the first set of slots 18 in order to support a weight bar 20 and associated weights 22. Spotter bars 400 span between the front riser 74 and rear riser 76 and are fastened to the riser 74 and 76 by insertion of the tabs 412 into the side slots 78 formed in front riser 74 and rear riser 76.

The spotter bar 400 serves as a spotter and safety stop for a user performing exercise within the full-cage 70. If the bar 20 is dropped or if the user is unable to return it to the bar support member 100, the spotter bars 400 will capture and support the weight bar 20. As discussed above, the spotter bar 400 should most preferably be adjusted such that the top of the bar support member 402 is at or slightly below the height of the weight bar 20 at the bottom-most range of motion for a given exercise.

Figure 56:
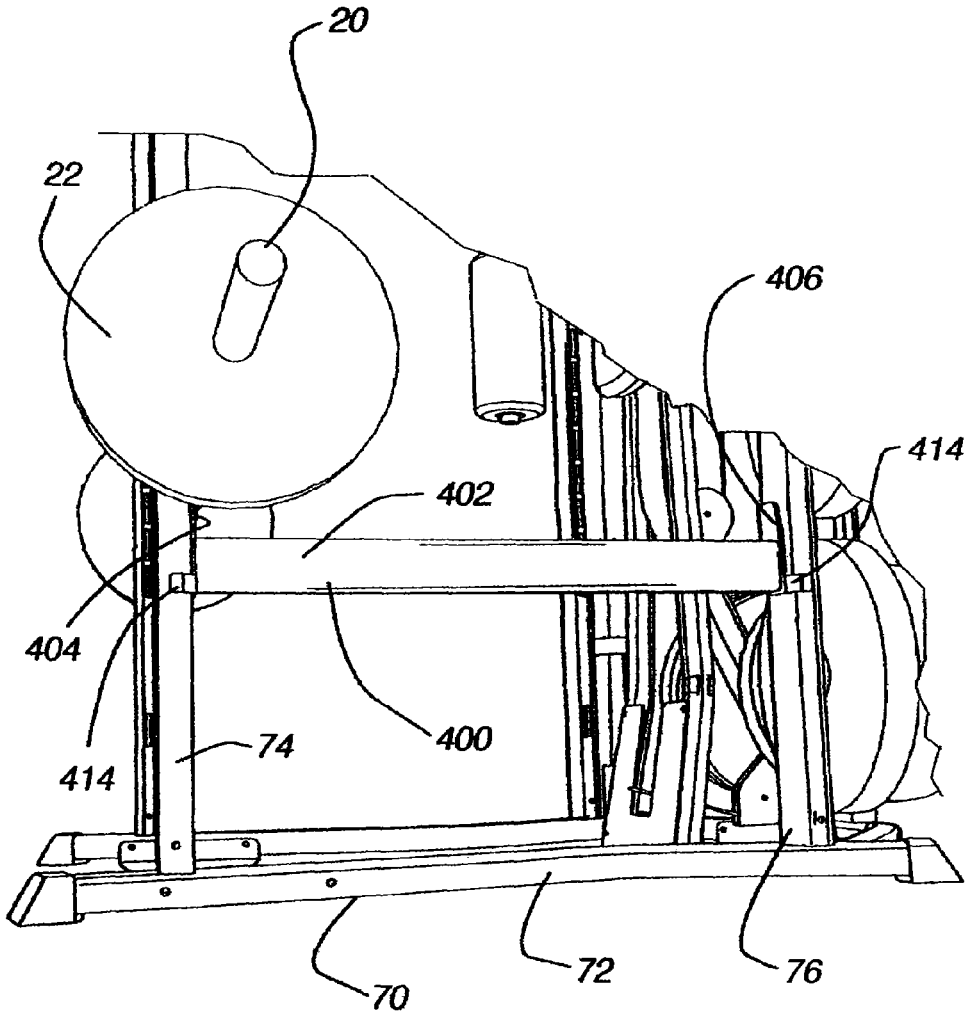
FIG. 56 is a partial enlarged detail view of the full-cage weight rack and spotter bar of FIG. 55.
Figure 57:
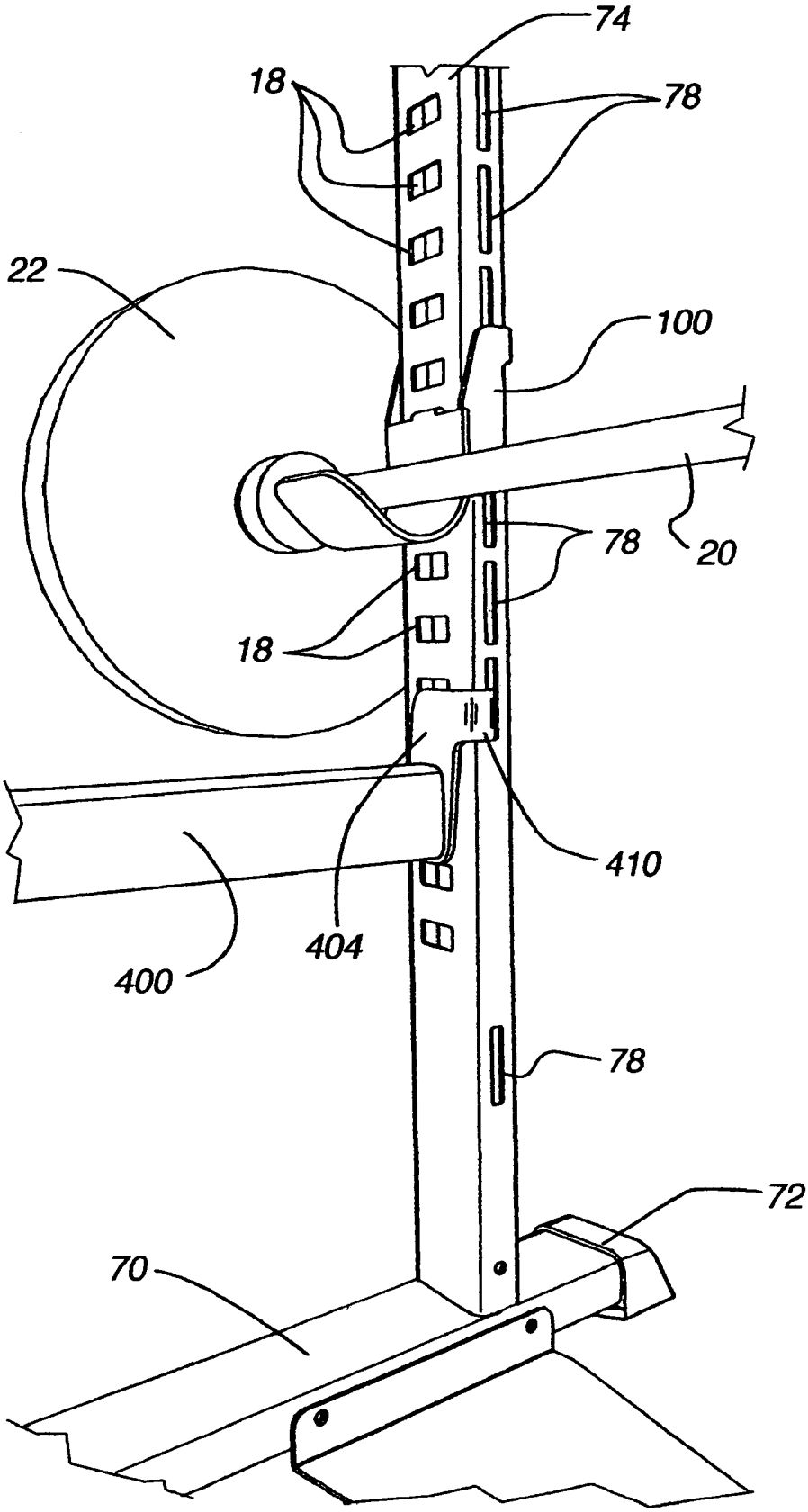
FIG. 57 is a partial enlarged detail view of the front right riser of the full-cage weight rack of FIG. 55.

FIG. 56 is an enlarged detail view of the lower right portion of the full-cage 70 from FIG. 55. It can be seen that lower protrusions 414 of the attachment brackets 404 and 406 rest against an outside surface of the front and rear risers 74 and 76 respectively. The inner side surface of the left front riser 74 is visible in FIG. 57. A plurality of side slots 78 are vertically spaced along the inner surface of the front riser 74. The tab 412 on upper protrusion 410 is inserted into the desired slot 78 in order to locate the spotter bar 400 at a desired height. The second attachment bracket 406 connects with the rear riser 76 in the same fashion.

Figure 58:
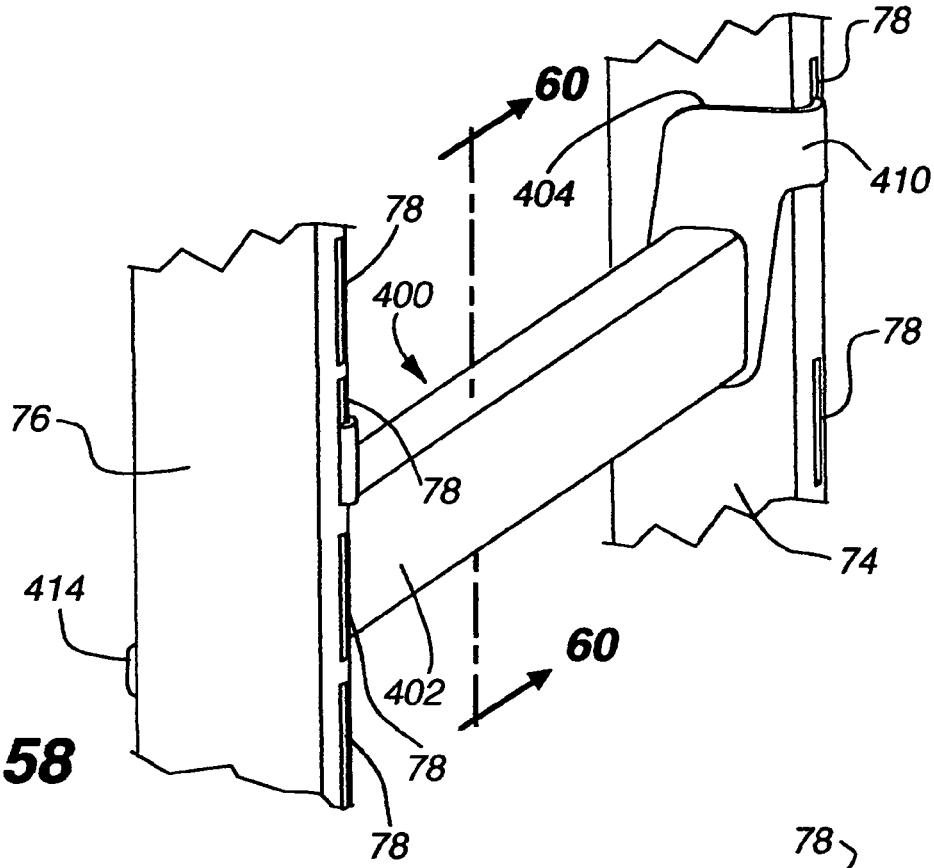
FIG. 58 is a partial isometric view of the front and rear left risers of the full-cage weight rack of FIG. 55 including the associated spotter bar adjusted to a spotting configuration.
Figure 60:
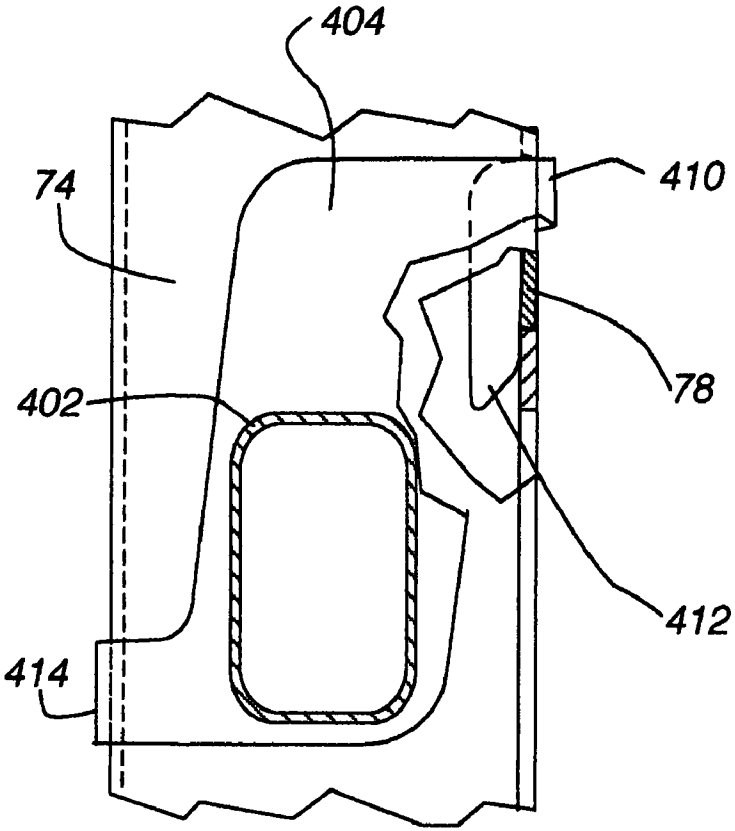
FIG. 60 is a partial cross sectional view of the spotter bar and riser from FIG. 58 taken along line 60-60 of FIG. 58 with a portion of the riser and spotter bar cut away.

FIGS. 58 and 60 illustrate the spotter bar 400 in an engaged working position on the front riser 74 and rear riser 76. In this engaged working position, the tab 412 with the angled tip is extended into a side slot 78 such that a bottom edge of the upper protrusion 410 rests on an upper surface of the slot 78. The lower protrusion 414 presses against the opposite side faces of the front riser 74 and rear riser 76 to prevent the spotter bar 400 from rotating beyond the desired position. With both of the attachment brackets 404 and 406 attached to their respective risers 74 and 76 the spotter bar 400 is securely fastened such that the spotter bar 400 may be used to support an appropriate weight bar 20.

Figure 59:
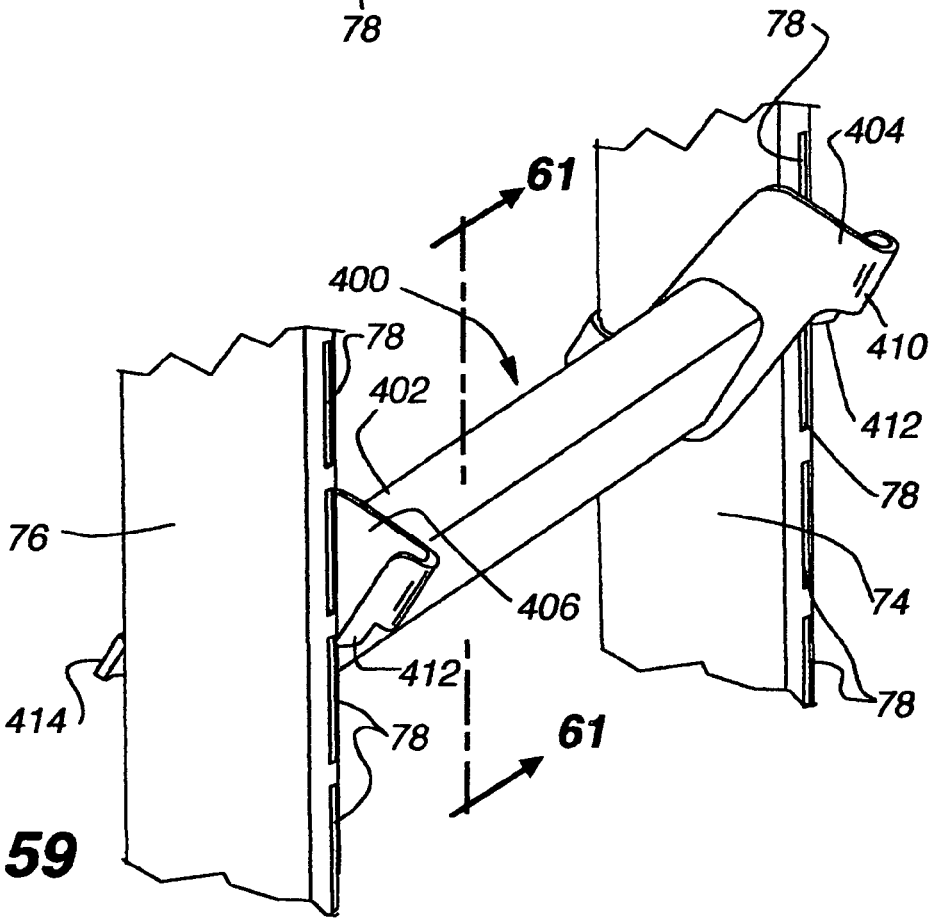
FIG. 59 is a partial detail isometric view of the riser bars and spotter bar of FIG. 58 with the spotter bar in a tilted adjustable configuration.
Figure 61:
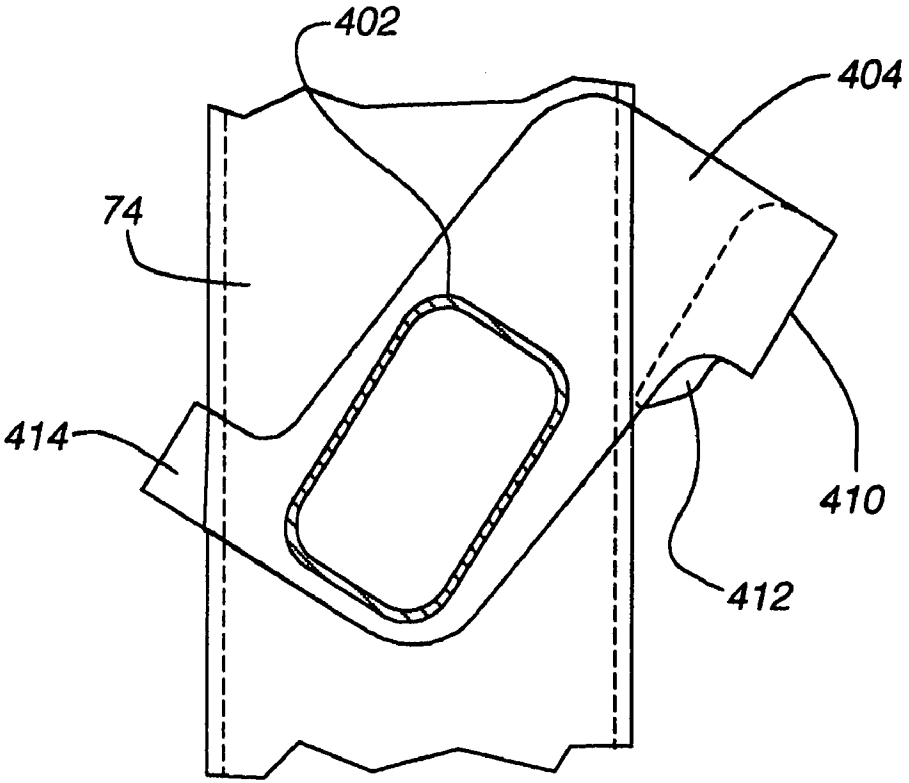
FIG. 61 is a cross sectional view of the spotter bar and riser of FIG. 59 taken along line 61-61 of FIG. 59.

In order to adjust the spotter bar 400 to a desired height on the risers 74 and 76 the spotter bar 400 is lifted and rotated to the position shown in FIGS. 59 and 61. In this position the tabs 412 on the upper protrusions 410 have been completely withdrawn from the slots 78 and the spotter bar 400 may be slid up and down along the length of the front riser 74 and rear riser 76. When the spotter bar 400 has been adjusted to the desired height, the tabs 412 are inserted into the corresponding slots 78 and the spotter bar 400 is rotated and lowered back into the position shown in FIGS. 58 and 60.

The spotter bars 400 can be positioned relative to one and other in a parallel relationship, or in an angled relationship if desired. Similarly, the height of each spotter bar 400 from the floor can be the same, or may be unequal depending upon the particular implementation.

Therefore, it can be seen that embodiments of the present invention provide a system that can be used in a piece of exercise equipment. In one example, the system can include one or more upright members having a plurality of apertures, and one or more weight bar holders can be slid along the upright members and secured at a desired location. The system may also include one or more safety stops or spotters that are similarly adjustable along the upright members.

While the invention has been particularly shown and described with reference to embodiments thereof, it should be understood by those skilled in the art that various other changes in the form and detail may be made without departing from the spirit and scope of the invention. For example, while the weight bar has been shown as generally an elongated cylindrical bar, it is understood that embodiments of the present invention could be used with weight bars of different shapes, such as weight bars with angled hand hold portions or other shapes.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. An exercise device for use with a weight bar, comprising:

a first upright member including a plurality of apertures;

a second upright member including a plurality of apertures;

a first weight bar holder, said first weight bar holder including:

a body portion including a front member and a pair of side members that extend generally rearwardly from the front member;

a retainer attached to the side members such that the retainer is offset rearwardly from the front member; the front member, side members, and retainer forming a first passageway for receiving the first upright member such that the body and the retainer are slidable together on the first upright member;

a bar support member operatively associated with the body portion; and an engagement member extending from the front member towards the retainer at a generally downward angle with respect to the front member for securement within one of said plurality of apertures of said first upright member; and a second weight bar holder, said second weight bar holder including a body portion, a bar support member operatively associated with the body portion, and an engagement member operatively associated with the body portion, said engagement member for securement within one of said plurality of apertures of said second upright member.

2. The exercise device of claim 1, wherein the bar support member of the first weight bar holder includes a curved cradle for supporting a first portion of the weight bar therein, and the bar support member of the second weight bar holder includes a curved cradle for supporting a second portion of the weight bar therein.

3. The exercise device of claim 1, wherein the bar support member of the first weight bar holder includes an elongated bar support for supporting a first portion of the weight bar, and the bar support member of the second weight bar holder includes an elongated bar support for supporting a second portion of the weight bar.

4. The exercise device of claim 1, wherein the exercise device includes a first guide bar associated with the first upright member and a second guide bar associated with the second upright member, wherein a first shuttle is slidably connected to the first guide bar for movement of the shuttle along the first guide bar and a second shuttle is slidably connected to the second guide bar, wherein the weight bar is operably attached to the first and second shuttles for movement along a path defined by the guide bars, and wherein the bar support member of the first weight bar holder includes a bearing surface for supporting a first portion of the first shuttle, and the bar support member of the second weight bar holder includes a bearing surface for supporting a second portion of the second shuttle.

5. A weight bar support for supporting a portion of a weight bar on an exercise device of the type that includes an upright with a plurality of vertically spaced apertures; the weight support comprising:

a body including a front member and a pair of side members that extend generally rearwardly from the front member;

a retainer attached to the side members such that the retainer is offset rearwardly from the front member; the front member, side members, and retainer forming a first passageway for receiving the upright such that the body and retainer are slidable together on the upright;

an engagement member extending from the front member towards the retainer at a generally downward angle with respect to the front member for selective engagement with the vertically spaced apertures in the upright member to prevent the body and retainer from sliding on the upright when the engagement member is engaged with one of the apertures; and a weight bar support member extending generally forwardly from the body for supporting a portion of the weight bar on the exercise machine when the engagement member is engaged with one of the apertures.

6. The weight bar support of claim 5, wherein the retainer includes a front face for engagement with a rear portion of the upright member and the front member includes a rear face for engagement with a front portion of the upright, and further wherein the front face of the retainer is offset vertically from the rear face of the front member such that the front face of the retainer and the rear face of the front member can be brought into and out of engagement with the upright by tilting movement of the weight support.

7. The weight bar support of claim 6 wherein when the engagement member is engaged with one of the apertures and the weight bar support member is supporting a portion of the weight bar, the front face of the retainer is urged into engagement with the rear portion of the upright and the rear face of the front member is urged into engagement with the front portion of the upright.

8. The weight bar support of claim 7, wherein the front face of the retainer and the rear face of the front member are provided with gripping pads.

9. The weight support of claim 5, wherein the weight bar support member comprises a cradle portion with a generally J-shaped cross section for supporting a portion of the weight bar.

10. The weight bar support of claim 5, wherein the weight bar support member comprises an elongated bar support for supporting a portion of the weight bar such that the weight support is suitable for use as a spotter.

11. The weight bar support of claim 5, wherein the exercise machine includes a guide bar associated with the upright member, wherein a shuttle is slidably connected to the guide bar for movement of the shuttle along the guide bar, wherein the weight bar is operably attached to the shuttle for movement along a path defined by the guide bar, and wherein the weight bar support member includes a bearing surface for supporting a portion of the shuttle.

12. The weight bar support of claim 11, wherein the weight bar support member includes a second passageway provided through the bearing surface for receipt of the guide bar.

13. The weight bar support of claim 12, wherein the engagement member extends from the front member into the first passageway at a location laterally offset from a center of the front member.

14. An exercise device comprising the weight bar support of claim 5.

* * * * *